US005205355A

United States Patent [19]

Gay et al.

[11] Patent Number: 5,205,355

[45] Date of Patent: Apr. 27, 1993

[54] SUBSURFACE SAFETY VALVES AND METHOD AND APPARATUS FOR THEIR OPERATION

[75] Inventors: Marion H. Gay, Houston; Phillip S. Sizer, Dallas; Imre I. Gazda, Fort Worth, all of Tex.

[73] Assignee: Otis Engineering Corp., Dallas, Tex.

[21] Appl. No.: 884,831

[22] Filed: May 18, 1992

Related U.S. Application Data

[62] Division of Ser. No. 699,454, May 13, 1991.

[51] Int. Cl.[5] ..... E21B 23/02

[52] U.S. Cl. ..... 166/72; 166/382

[58] Field of Search ..... 166/381, 382, 237, 72, 166/123, 319, 320, 322, 323

[56] References Cited

U.S. PATENT DOCUMENTS 3,747,682 7/1973 Taylor ..... 166/136 X 4,098,335 7/1978 Goad ..... 166/120

4,582,136 4/1986 Skinner ..... 166/382 X

*Primary Examiner*—Wiliam P. Neuder

*Attorney, Agent, or Firm*—M. H. Gay

[57] ABSTRACT

Method and apparatus for pressurizing the top of the valve member of a subsurface safety to equalized pressure thereacross and assist in opening the valve. The apparatus includes a chamber filled with fluid under pressure which is admitted in to the space between the apparatus and a valve when landed in the valve to pressurized the valve. A spring loaded prong on the apparatus urges the valve member of the safety valve to open position. A latch is included which will bypass a top landing nipple and land in a second landing nipple. The subsurface safety valve is provided with means for filling its spring chamber with liquid with the valve closed. When the safety valve is open the spring chamber is isolated to protect the chamber from flow of fluids and solids.

3 Claims, 33 Drawing Sheets

SUBSURFACE SAFETY VALVES AND METHOD AND APPARATUS FOR THEIR OPERATION

This is a division of application Ser. No. 07/699,454 filed May 13, 1991.

This invention relates to subsurface safety valves and to methods and apparatus for opening valves under high pressure differential without damage to the valves. The apparatus and methods include a system for pressurizing a safety valve to equalize pressure across a valve member to permit it being opened without damage to the valve, a new bypass latch for latching in a landing nipple, a new safety valve and methods for operating the valve and latch.

When a subsurface safety valve is closed a very high differential may be present across the valve member making it difficult if not impossible to open the valve. To provide for maximum flow, the flowway through the valve must be large. This results in a large diameter valve member to be opened. The large flowway also limits the area available for the opening piston for the valve. The result is a small diameter piston area for opening a large diameter valve member.

Past efforts have been in the direction of having the valve actuator first opening a small equalizing valve to equalize pressure across the valve member before it is moved to open position. Many different designs employing equalizing valves have been proposed and utilized. Examples of equalizing valves are found in U.S. Pat. Nos. 3,799,204; 3,971,438; 3,078,932 and 4,478,286. Each of these designs has a common problem. High pressure fluid are first equalized through a small equalizing valve before the main valve member is opened. As well fluids may contain solids such as sand, the equalizing valves are frequently damaged by the solid containing fluids passing therethrough during equalizing pressure across the main valve member. Such damage results in expensive workover operations to pull the tubing and replace the safety valve. This invention solves this problem by providing for equalizing pressure across the main valve member of a safety valve without providing equalizing pressure from below the valve.

In accordance with this invention a plug is landed in the tubing and the valve is sealed off from the tubing thereabove. Then pressurized fluid carried by the plug is released to be effective above the valve member of the safety valve to equalized pressure thereacross. The safety valve may then be opened. After the safety valve is opened pressure is equalized across the plug and the plug removed from the well. As there is no flow of high velocity fluid across any part of the subsurface safety valve the safety valve is not damaged during equalization of pressure across the safety valve. High velocity flow which may damage valve members and seats is confined to the plug. The plug is removed after each use and may be redressed without the cost of a well workover as the plug may be run in the well tubing using standard procedures such as wire line procedures.

In many installations a subsurface safety valve in run with a landing nipple immediately below the well head with another landing nipple immediately above the safety valve. In accordance with this invention a bypass latch is provided which in passing through the upper landing nipple is cocked for engagement with the landing nipple immediately above the safety valve.

Standard subsurface safety valves have a spring chamber which inherantly provides an air or gas reservoir. This invention provides a new safety valve in which the spring chamber is protected against solids reaching the spring chamber and inhibits flow through the chamber to protect against corrosion. The new safety valve permits the spring chamber to be filled with liquid when the safety valve is closed thus reducing the volume of pressure fluid needed to pressurize the safety valve above its valve member before it is opened.

It is an object of this invention to provide a method and apparatus for landing a plug in a tubing and pressurizing the area between the plug and the valve member of a subsurface safety valve with pressurized fluid carried by the plug to equalize pressure across the valve member prior to moving the valve member to open position and thereafter equalizing pressure across the plug.

It is a further object to provide apparatus and method of equalizing pressure across a subsurface safety valve in which a plug is landed above the valve member of a safety valve, the area between the plug and valve member is pressurized with pressure carried by the plug, means carried by the plug unseats the valve member of the safety valve, and pressure is equalized across the plug prior to its removal from the well tubing.

Another object is to provide a bypass latch which bypasses a first landing nipple and is activated therein to land in a second nipple located therebelow.

Another object is to provide a bypass latch as in the preceding object in which the operation of the bypass latch is coordinated with control of flow of fluids from a chamber in a plug associated with the latch.

Another object is to provide a plug having a charge of fluid under pressure and a bypass latch for bypassing a top landing nipple and landing in a lower landing nipple in which a single actuator controls landing and release of the latch and control of release of pressure fluid into the tubing below the plug and thereafter equalization of pressure across the plug.

Another object is to provide a subsurface safety valve and a method of operating the valve in which the spring chamber may be protected from damage and solids accumulation during flow of the well and may be filled with liquid when the valve is closed.

Other objects, features and advantages of the invention will be apparent from the drawings, the specification and the claims.

In the drawings wherein illustrative embodiments of the invention are shown and wherein like parts are indicated by like numbers;

Figure 1A:
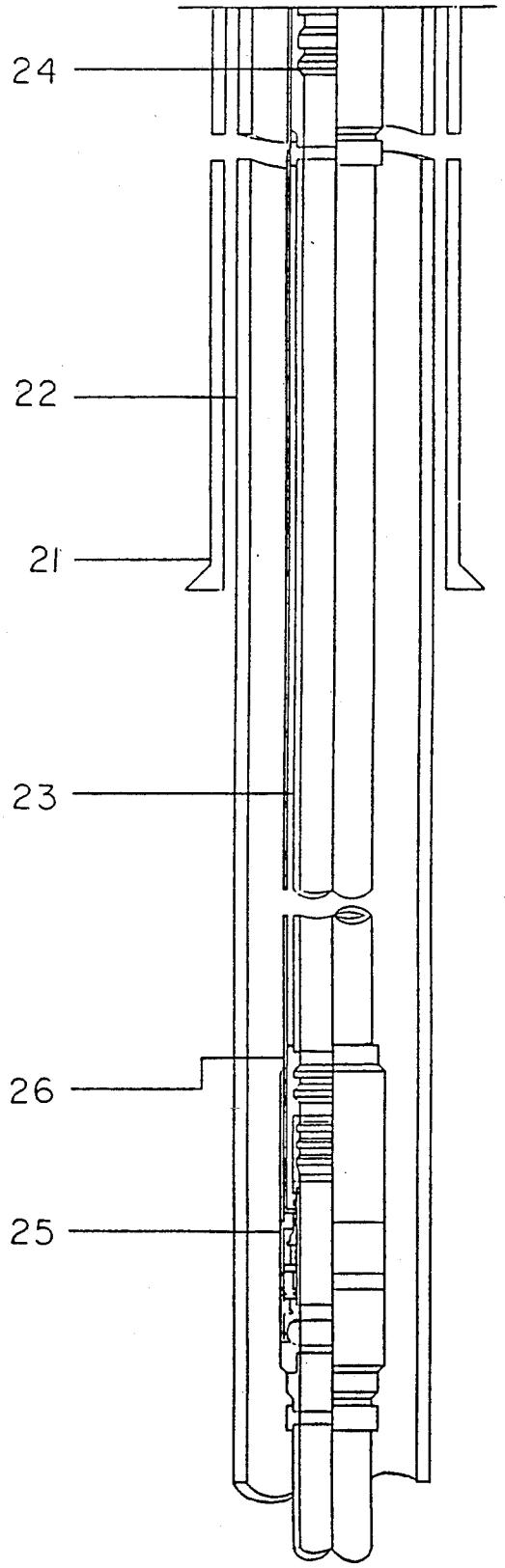
FIG. 1 is a schematic view partly in elevation and partly in section illustrating a well having a subsurface safety valve therein which may be operated in accordance with this invention.

In practicing the methods of this invention a plug including a chamber filled with fluid, preferably a divided chamber with liquid and gas, is latched in and sealed to the tubing immediately above the valve member of a subsurface safety valve. The chamber is communicated with the tubing between the valve member and plug and the fluid injected into the tubing to pressurize the tubing above the valve member to a value such that the differential across the valve member will not prevent the valve from being opened by normal operation of the safety valve. Preferably the pressure below the valve member is equalized by a source of pressure exceeding the pressure below the valve member and a spring loaded plunger on the plug moves the valve member off its seat. The valve is then fully opened by pressure applied from the surface in the control line being increased to a to valve exerting a force which overcomes back pressure on the piston of the valve and the force of the spring urging the piston to closed position. As no integral equalizing valve is opened during equalizing of pressure across the valve member there is no cutting of a valve member as is generally experienced with the prior methods of opening safety valves against a high differential. After the safety valve has been opened to its full open position communication is established across the plug to equalize the differential thereacross. The plug is then removed from the well and normal operation resumed.

The method may be advantageously used to test the effectiveness of the seal across a valve of a subsurface safety valve. For instance it may be desirable to test on a monthly basis the effectiveness of safety valves installed in gas wells.

In gas wells, standard designs have a spring chamber filled with air or gas. Pressurizing this area from the chamber in the plug is undesirable. Preferably the design of the valve permits the chamber to be filled with liquid. Before running the plug, liquid such as water, glycol or any other desired liquid is introduced into the spring chamber. For instance a bailer may be run to dump the liquid into the tubing above the closed safety valve to fill the spring chamber. With oil wells liquid will normally be present in the tubing above the safety valve when the valve is closed and this liquid will fill or substantially fill the spring chamber. Advantageously the safety valve of this invention may be used even with oil wells as it insures that the spring chamber is filled with liquid. After the liquid is spotted in the well the plug is run and the closed valve opened as described above.

As will appear hereinbelow it is preferred to run the plug on a wireline and control the method by manipulation of the wire line. Other systems may be used. For instance an inertia timer may be used to control opening and closing of valves containing fluid in the charge chamber and an equalizing passageway through the plug. Details of the several methods will appear herein below.

Figure 1B:
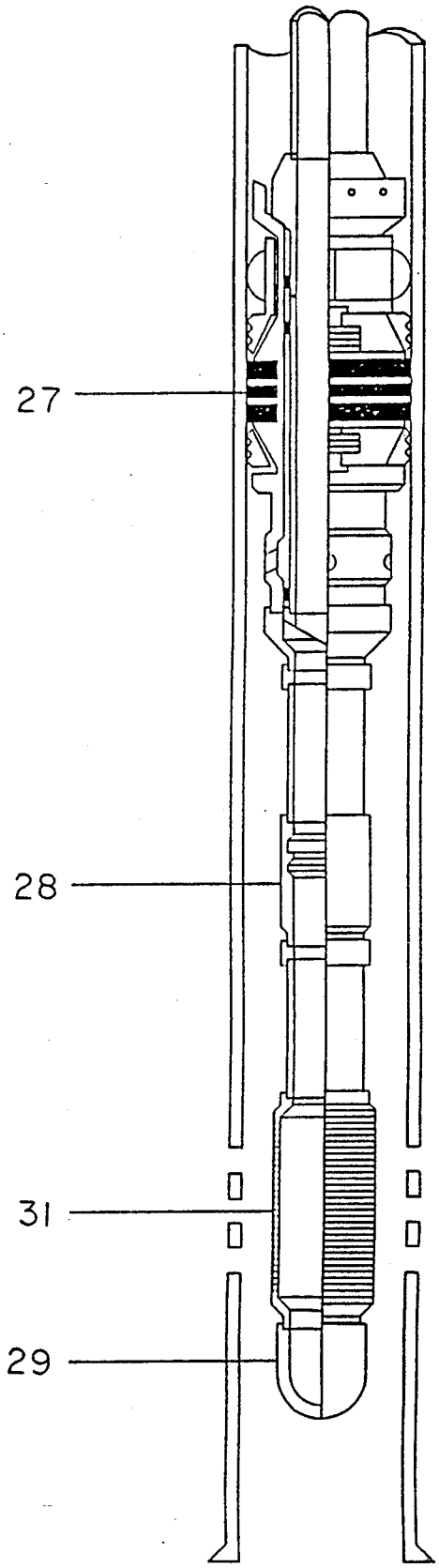

FIG. 1 illustrates a well in which this invention may be used. A surface casing 21 is suspended from a wellhead (not shown) as is a well casing 22 and a production tubing 23. At the upper end of the tubing a landing nipple 24 may be provided for receiving equipment such as a plug to isolate the wellhead from the tubing when desired. A subsurface safety valve 25 is provided in the tubing for shutting in the well in response to pressure conditions in a control line 26. A packer 27 seals the well annulus A landing nipple 28 may be provided below the valve 25. The bottom of the tubing is closed by a bull plug 29 and flow into the tubing is through a screen 31.

The preferred apparatus for opening a closed safety valve is shown in FIG. 2A through 2E. A preferred new safety valve and bypass latch are also shown. The bypass latch is indicated generally at 32 in FIG. 2A. The plug is indicated generally at 33 in FIGS. 2B through 2E. The subsurface safety valve is indicated generally at 34 in FIGS. 2B through 2E.

The plug 33 and/or latch 32 is also shown in all remaining FIGS. except FIGS. 14A, 14B, 15A, 15B and 15C wherein modified forms are shown. For clarity of illustration of the plug 33 alone it will be described principally with reference to FIGS. 5A and 5B.

The plug 33 includes a chamber of fluid under pressure for injecting into the tubing between the plug and valve member of the valve to be opened. The fluid movement is controlled by a three way valve means. In one position the valve means retains the fluid in the chamber. In a second position the valve means releases the fluid in the chamber into the tubing below the plug. In the third position the valve means communicates the fluid with the tubing above the plug. This results in pressurizing the upper surface of the valve to be opened to diminish the differential thereacoss during opening of the valve. After the valve has been opened the pressure across the plug is equalized to permit the plug to be removed Thus any damage resulting from flow of fluids under high differential occurs only in the plug as the pressure is equalized thereacross In as much as the plug is removed after each use it may be redressed at the surface to repair any damage This eliminates the necessity of an expensive workover to pull the safety valve to repair damage occuring during equalizing with a valve which is an integral part of the safety valve.

The tool to be run into the well includes the plug 33 and the latch 32. The plug has a housing provided by the packing mandrel 35, fluid bypass mandrel 36 threaded to the lower end of packing mandrel, valve housing 37 depending from and telescoped with the bypass mandrel, chamber cylinder 38 threaded to the lower end of the valve housing, a connecting sub 39 (FIG. 2E) threaded to the lower end of the chamber cylinder, and a bottom sub 41 (FIG. 2E.) threaded to the bottom of the connecting sub.

The packing mandrel carries a conventional seal 42 for sealing between the housing and the tubing, preferably at the lower section of the landing nipple 26 (FIG. 2B) when the latch keys of the bypass latch are in the locking profile 44 of the landing nipple.

Figure 2A:
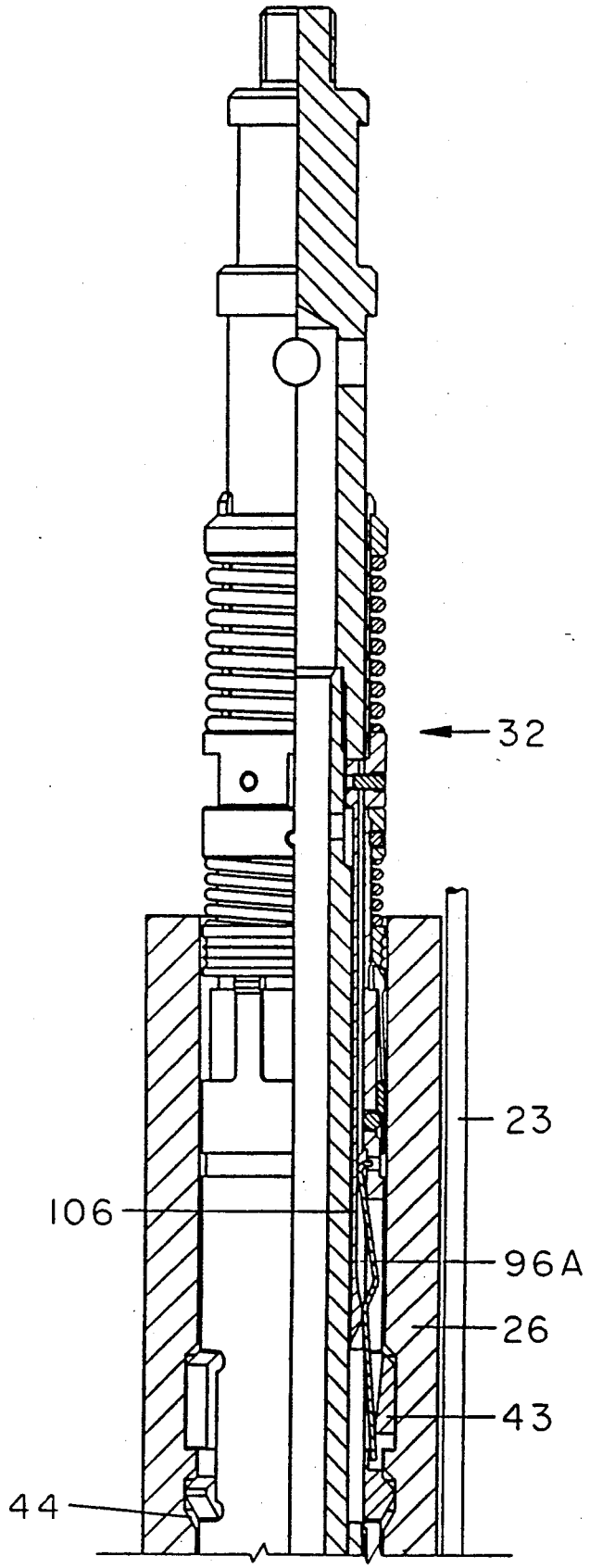
FIGS. 2A, 2B, 2C, 2D and 2E are continuation views partly in section and partly in elevation illustrating a safety valve, plug and latch constructed in accordance with this invention showing the keys landed and the pin between the plug actuator and housing sheared.

Within the chamber cylinder 38 there is provided a chamber for fluid under pressure Preferably the chamber is divided by floating piston 45, slidable in the cylinder 38, into an upper chamber 46 and a lower chamber 47. The upper chamber is filled with a liquid through charging valve 48 in the lower end of valve housing 37. The lower chamber is filled with a gas under pressure through charging valve 49 in the connecting sub 39. The liquid may be any incompressible fluid which can be injected from the plug into the area exterior of the plug between the seal 42 and the valve member 51 of the safety valve 34 (FIG. 2E). A suitable liquid is water or glycol or a mixture thereof Glycol will prevent solids formation when a high pressure differential is relieved. The gas may be any desired inert compressible fluid such as nitrogen.

In a well producing liquids the bore through the safety valve will normally be substantially filed with liquid. If not and with gas wells, liquids such as water or glycol may be spotted in the safety valve preferably to a level above the seal bore of the landing nipple 26.

If the area of the safety valve below the landing nipple 26 and within the bore or communicating with the bore through the valve is substantially filled with liquid the piston 45 may be omitted and the fluid chamber filled with gas. The structure shown is preferred as even with a substantially liquid filled safety valve, gas pockets may be present and the use of a charging liquid will permit compression of gas in such pockets with a minimum charge of gas in the plug.

Valve means are provided in the plug for releasing the liquid in upper chamber 46 into the bore of safety valve 34. The valve housing 37 and trap 52 provide a valve seat for spool valve member 53. The valve housing 37 has a blind bore 54 with a shoulder 55 therein limiting downward movement of the spool valve member. The trap 52 has a bore 56 extending therethrough for receiving the spool valve member and a downwardly facing shoulder 57 limiting upward movement of the spool valve member. The bore through the trap is smaller in diameter than the housing bore 54 and O-rings 58 and 59 on the larger and smaller diameter sections of the spool valve provide sliding seals with the valve seat and a pressure responsive piston 60. The spool valve member has a bore 62. The piston and bore 62 are for a purpose which will appear hereinafter. The spool valve member also carries upper O-ring 61 for sealing with the bore 56. The valve housing 37 has a flowway 63 which communicates the upper chamber 46 with a port 64 in trap 52 which communicates with the bore in the trap. The trap also has exit ports 65 which communicate with the exterior of the body through retainer screws 66.

Figure 5A:
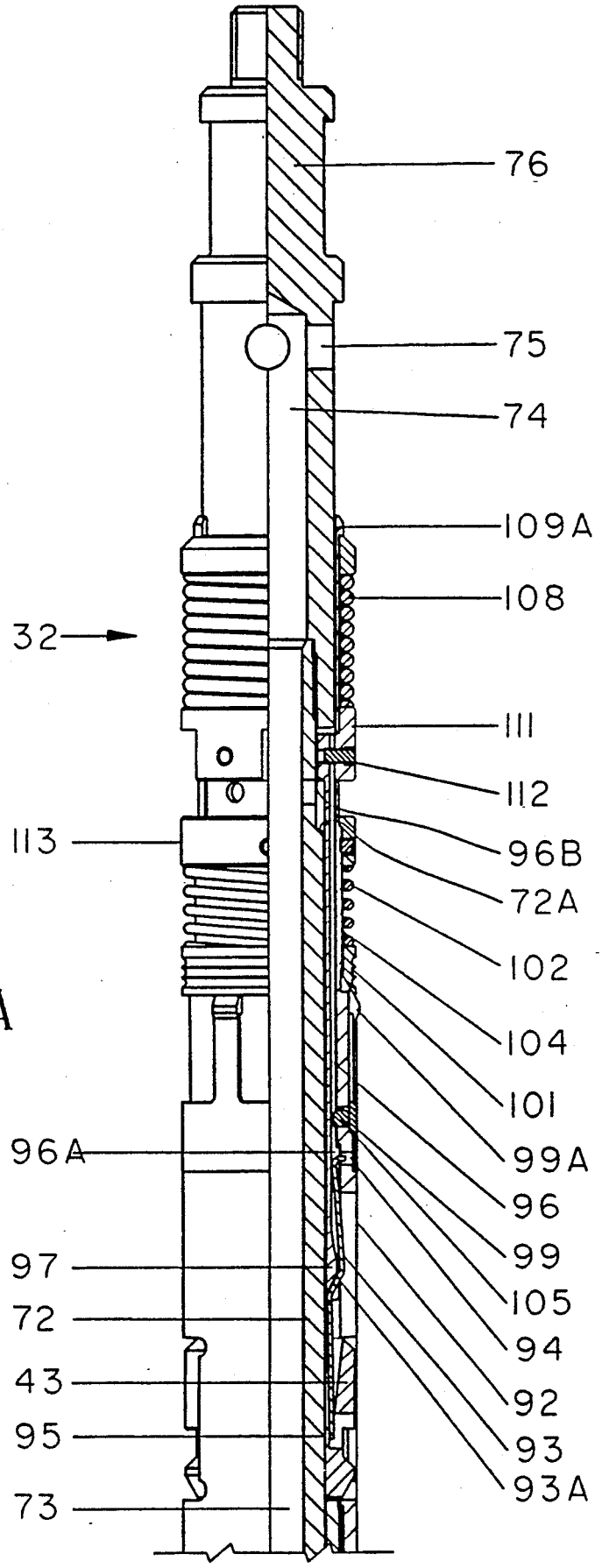
FIGS. 5A and 5B are continuation views partly in elevation and partly in section of the latch and plug with the bottom of the plug omitted and the tool in condition for running in a well.
Figure 5B:
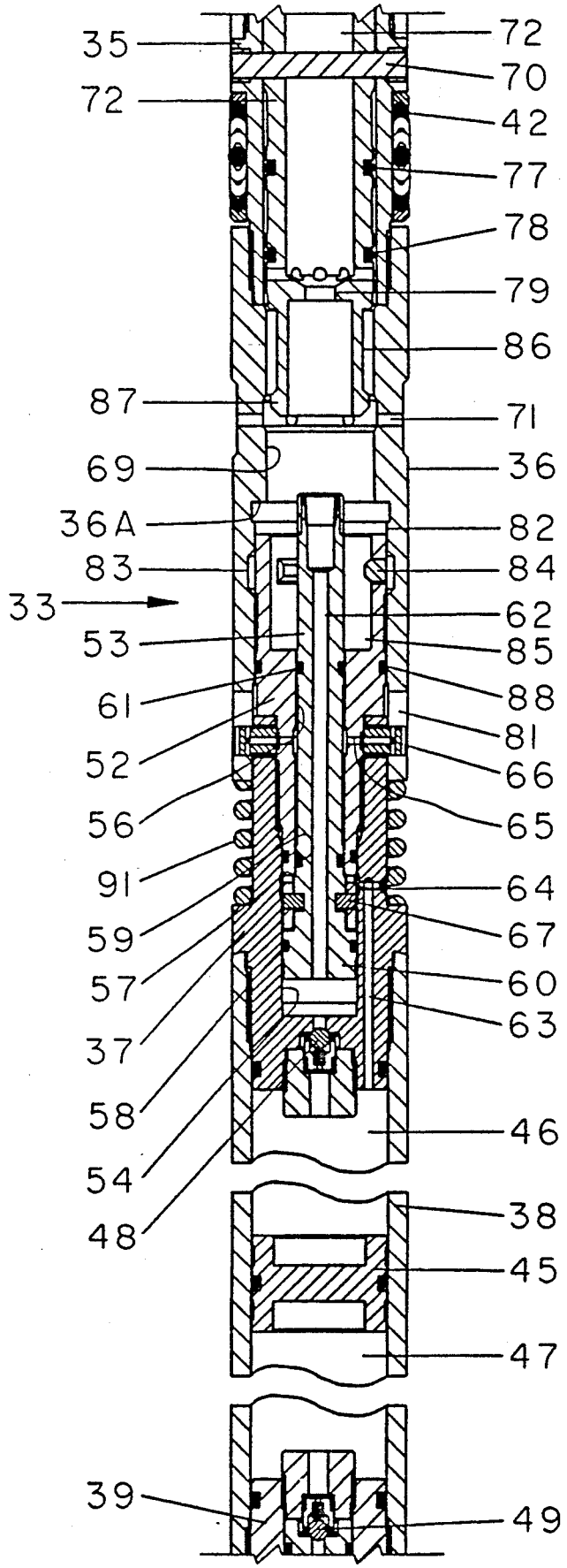

With the spool valve in closed position as shown in FIG. 5B, O-rings 58 and 59 straddle port 64 and O-rings 59 and 61 straddle port 65 preventing flow through the ports. The spool valve member is pinned in this position by shear pins 67.

When the spool valve member 53 is jarred downwardly and pins 67 are sheared, chamber pressure is effective on the top of piston 60 and tubing pressure above the plug is effective on the bottom of the piston through bore 62 in the spool valve member. The higher chamber pressure forces the piston down and hold it in down position so long as this differential exists to insure communication between the upper chamber and the exterior through ports 64 and 65 as O-ring 59 no longer engages the bore through the trap 52 and O-ring 61 prevents flow upwardly through the trap bore.

During running of the tool, fluid should be permitted to freely bypass the tool and its seal 42. For this purpose the housing 36 is provided with a bore 69 which communicates with the exterior of the plug below the seal through ports 71. An actuator mandrel 72 is reciprocal in the bore 69 and in a like bore in packing mandrel 35 after shear pin 70 is sheared. The actuator 72 has a bore 73 therethrough which communicates with a bore 74 and lateral ports 75 in fishing neck 76. This permits fluid to bypass the seal during running or pulling of the tool.

The actuator 72 has spaced O-rings 77 and 78 which straddle ports 71 when the actuator is moved to its down position. The actuator also has a perforated internal flange 79 which engages the top of the spool valve 53. After the ports 71 are closed downward jarring will shear pins 67 and result in the spool valve moving to its full down position due to the pressure differential thereacross to open the chamber to the exterior. As the bypass ports 71 are closed the valve member 51 of the safety valve is pressurized on its upper surface to permit ready opening thereof by normal operation of the safety valve from the surface.

When the pressure is released from the plug it is effective in the spring chamber of the safety valve 34 and on its operating piston. This results in a sudden increase in the pressure in the control line and indicates to the operator that the tool is functioning properly. At this time the safety valve control line is pressurized to open the safety valve to full open position.

Figure 4A:
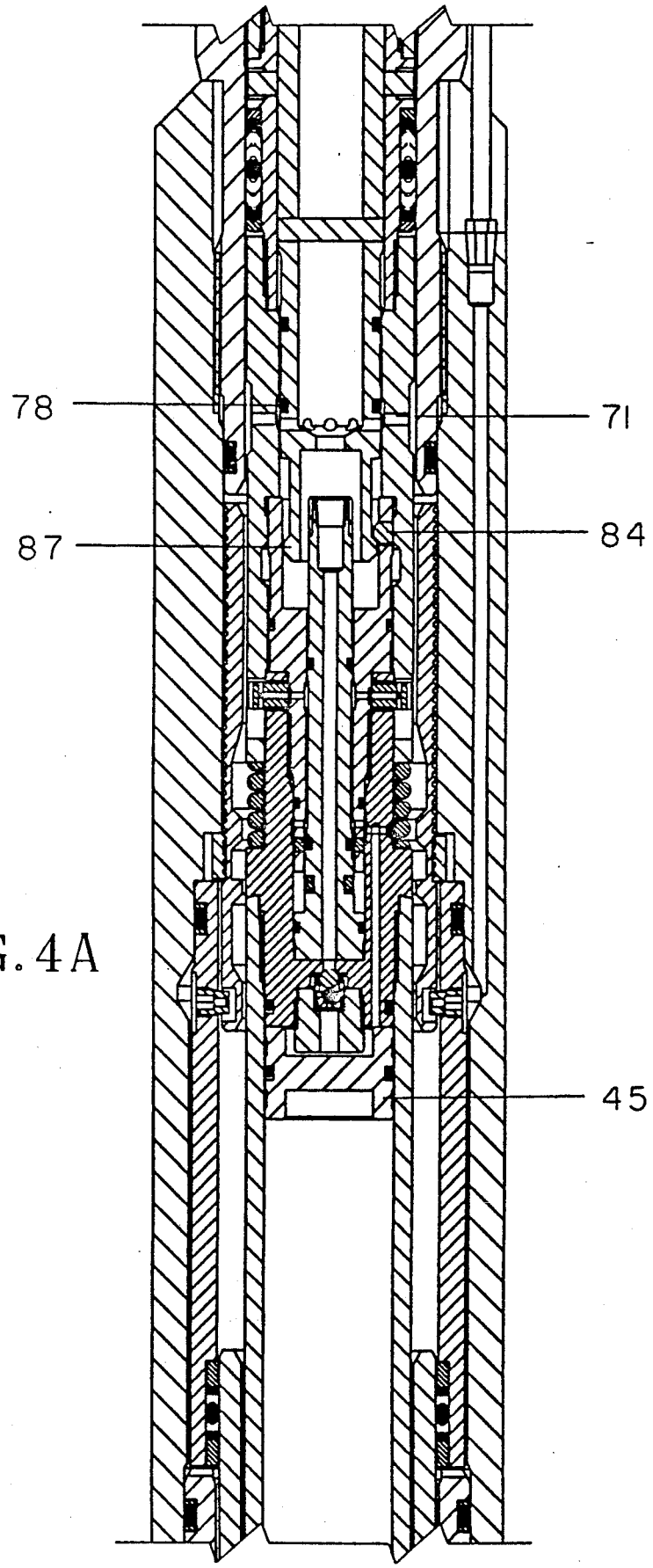
FIGS. 4A, 4B and 4C are similar sectional views of the tools shown in FIGS. 2B, 2C, and 2E showing the safety valve to have been opened and the pressure differential across the plug being equalized.
Figure 4B:
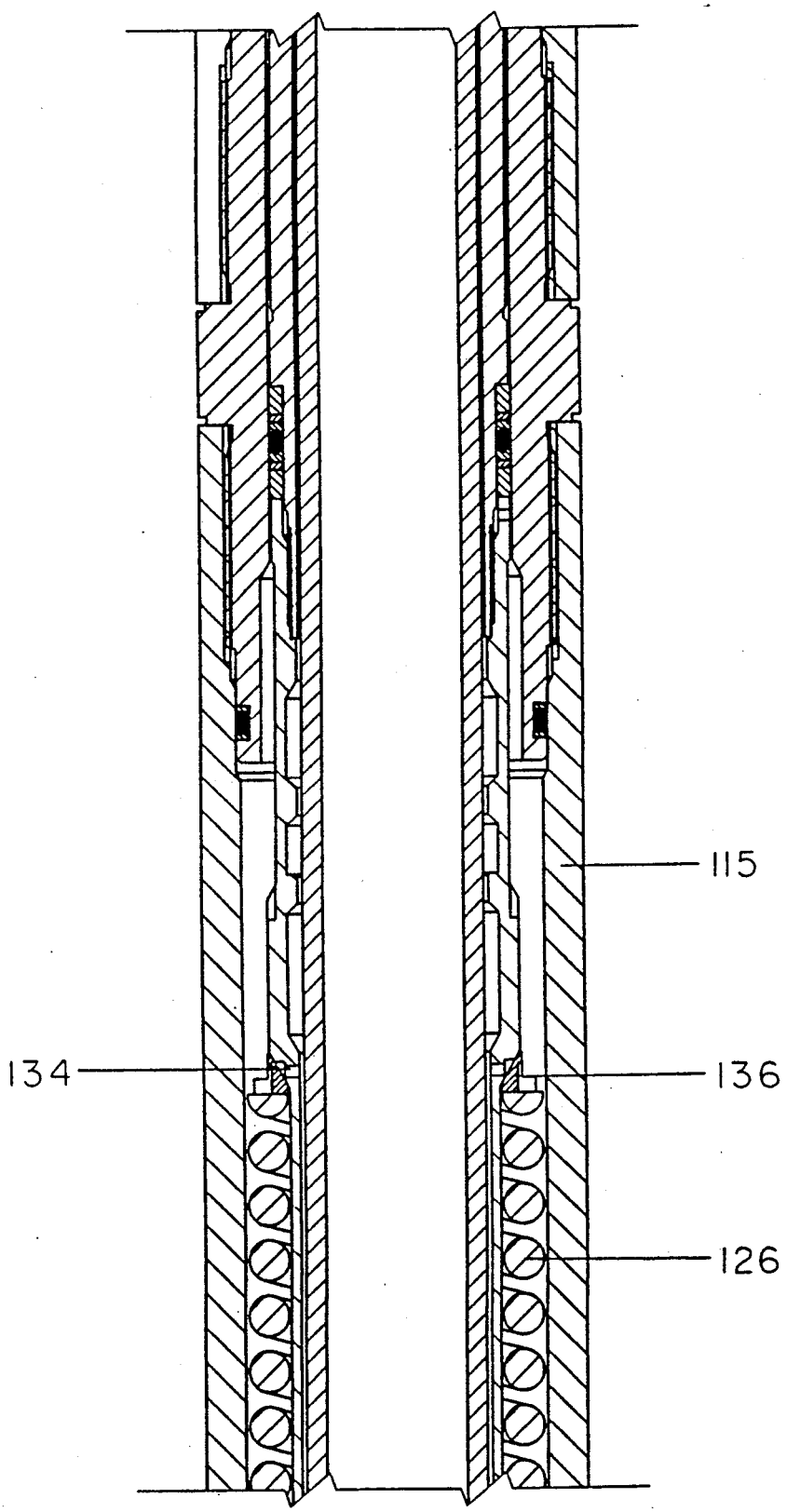
Figure 4C:
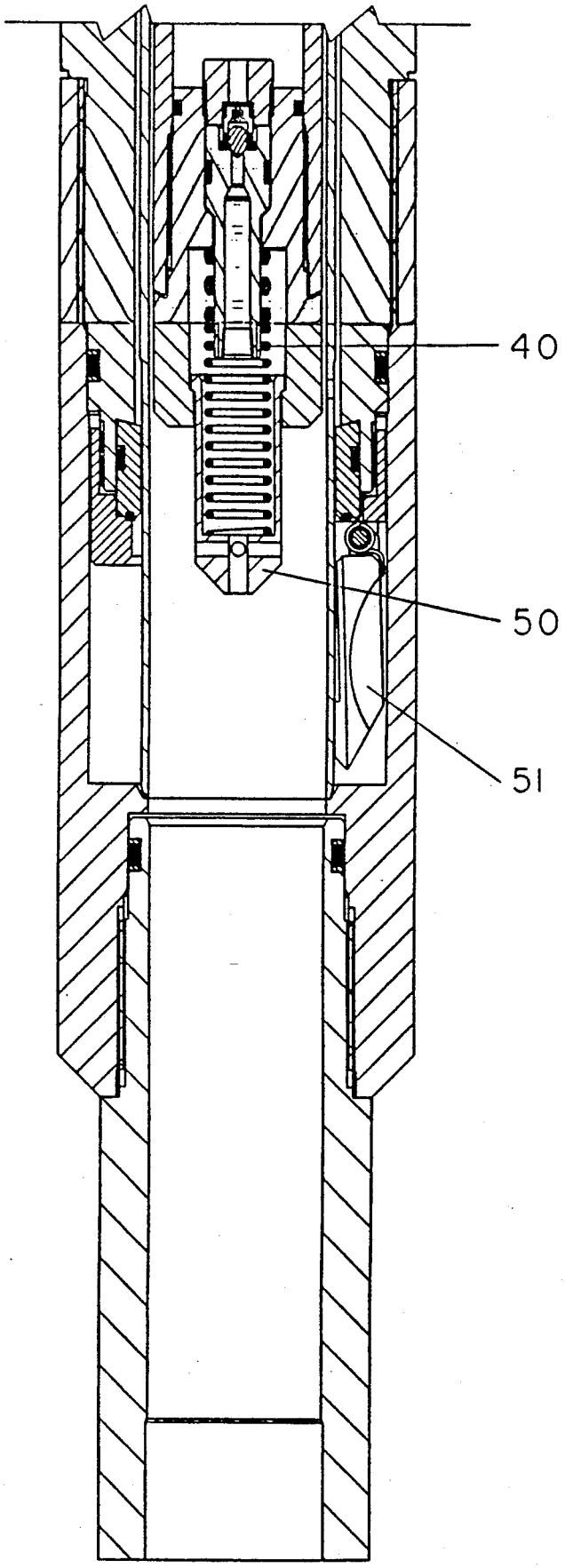

Desirably the plug is provided with means for unseating the valve member of the safety valve. For this purpose the plug is provided with a reciprocating prong 50 positioned in a bore **39*a* in connecting sub 39 and a bore 41*a* in bottom sub 41. The upper end of the prong has an outturned flange 50*a* which engages an upwardly facing shoulder 41*b* in the bore 41*a* of the bottom sub to limit downward movement of the prong. A spring 40 is compressed between the connecting sub 39 and the prong and exerts a downward force on the prong urging it to its fully extended position as shown in FIG. 4C. When the plug is landed this prong bears against the valve member 51 of the safety valve and the spring is compressed as shown in FIG. 2E. As soon as the pressure released from the plug equalizes pressure across the valve member 51 the prong is extended by the spring to move the valve member off its seat and thereafter pressure is equalized across the valve member 51 and will reflect well pressure below the valve member 51**. The operator at the surface will be aware of the pressure changes in the well as it is effective against the operating piston of the safety valve and reflected in the control line pressure gauge at the surface. Knowing that the pressure has been equalized and the valve moved off its seat the operator may then pressurize the control line to operate the safety valve and move its actuator to full open position to fully open the safety valve.

After the subsurface safety is open pressure is equalized across the plug and it is removed. The valve provided by straddle O-rings on the lower end of the actuator 72 is opened by raising the actuator until the lower O-ring 78 clears the ports 71 and pressure equalizes across the plug. As will later appear the latch 32 is released by upward movement of the actuator 72. Thus when the ports 71 are opened and high pressure fluid reaches the lower end of the actuator this fluid urges the actuator upwardly which is undesirable as the plug might be unlatched. Considerable forces may be developed as the confined fluid in the well below the safety valve are now effective on the actuator.

Means are preferably provided in the preferred plug for retaining the actuator in position with the lower O-ring 78 immediately above the ports 71 during equalization across the plug. For this purpose the housing is provided with the telescoping bypass housing 36 and valve housing 37. Vertical slots 81 are provided in the bypass housing 36 and retainer screws 66 carried by the valve housing 37 are reciprocal in these slots. As the trap 52 is threaded to the valve housing the trap and bypass housing are telescoped and travel is limited by the slots and retainer screws. The housing bore 82 in which the trap 52 reciprocates has a groove 83 and the trap carries lugs 84 which may move into this groove and which are projected into the bore 85 in the upper end of the trap when the lugs are not aligned with the groove. The lower end of the actuator 72 has a reduced diameter section 86 and an outwardly extending flange 87. When the actuator is in its lower position the reduced diameter section 86 is opposite the lugs 84 with the flange 87 below the lugs. An O-ring 88 seals between the trap 52 and bore 82 in housing 36. The trap thus is a piston exposed on its lower side to pressure below the plug and to tubing pressure above the plug. A return spring 91 urges the valve housing 37 and trap 52 downwardly relative to the housing 36. When the pressure is released from the chamber, the trap moves upwardly compressing the spring and moving the lugs out of groove 83 and into the reduced diameter section 86 of the actuator to slidably engage the actuator and limit its upward movement. When this occurs the top face of the trap 52 is against the internal shoulder **36*a* of housing 36** which restrains further upward movement.

To insure that equalization across the plug is completed it is preferred to place the wire line in tension during equalization to insure that the actuator remains in its equalizing position until pressure within the tubing above the plug indicates that equalization is complete. Then the tension in the wire line is relaxed and the spring 91 permitted to return the trap to its down position where the lugs may move into groove 83 and release the actuator. The plug can then be removed from the well by releasing the keys 43 and permitting them to retract.

The bypass latch 32 is designed to be tripped by passing through a top landing nipple 26 and to land in a lower landing nipple 26. Many wells are completed with the upper landing nipple and this bypass latch permits the tool to run through the top landing nipple.

Figure 16:
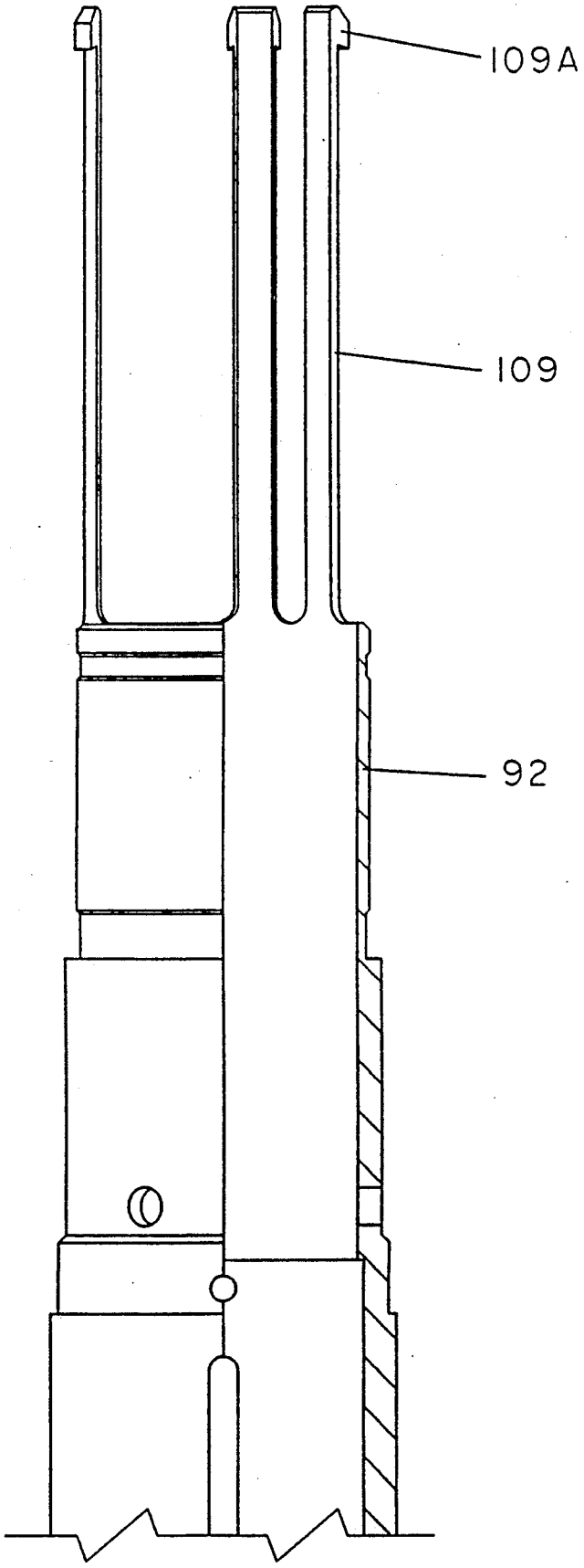
FIG. 16 is a view partly in section and partly in elevation of the upper section of the key retainer sleeve.

Keys 43 are carried in the key retainer sleeve 92 for radial movement outwardly into the landing profile 44 of the landing nipple. In the original assembled position (FIG. 5 A) the keys are held in retracted position by key springs 93. The springs are carried in the sleeve 92 in a hole 94 and engages a surface 95 on a key to urge in inwardly. The expander sleeve 96 has a vertical slot **96*a* in which the spring resides (FIG. 16). To expand the keys into engaging position an expander sleeve 96 has at its lower end a radially outwardly extending curved propout section 97. In its original assembled position shown in FIG. 5A the propout section is positioned is a curved section 93*a* of the spring 93** and has no effect on the spring. When moved downwardly to its FIG. 2A position the propout moves the spring radially outward where it exerts an outward force on the keys.

Figure 2B:
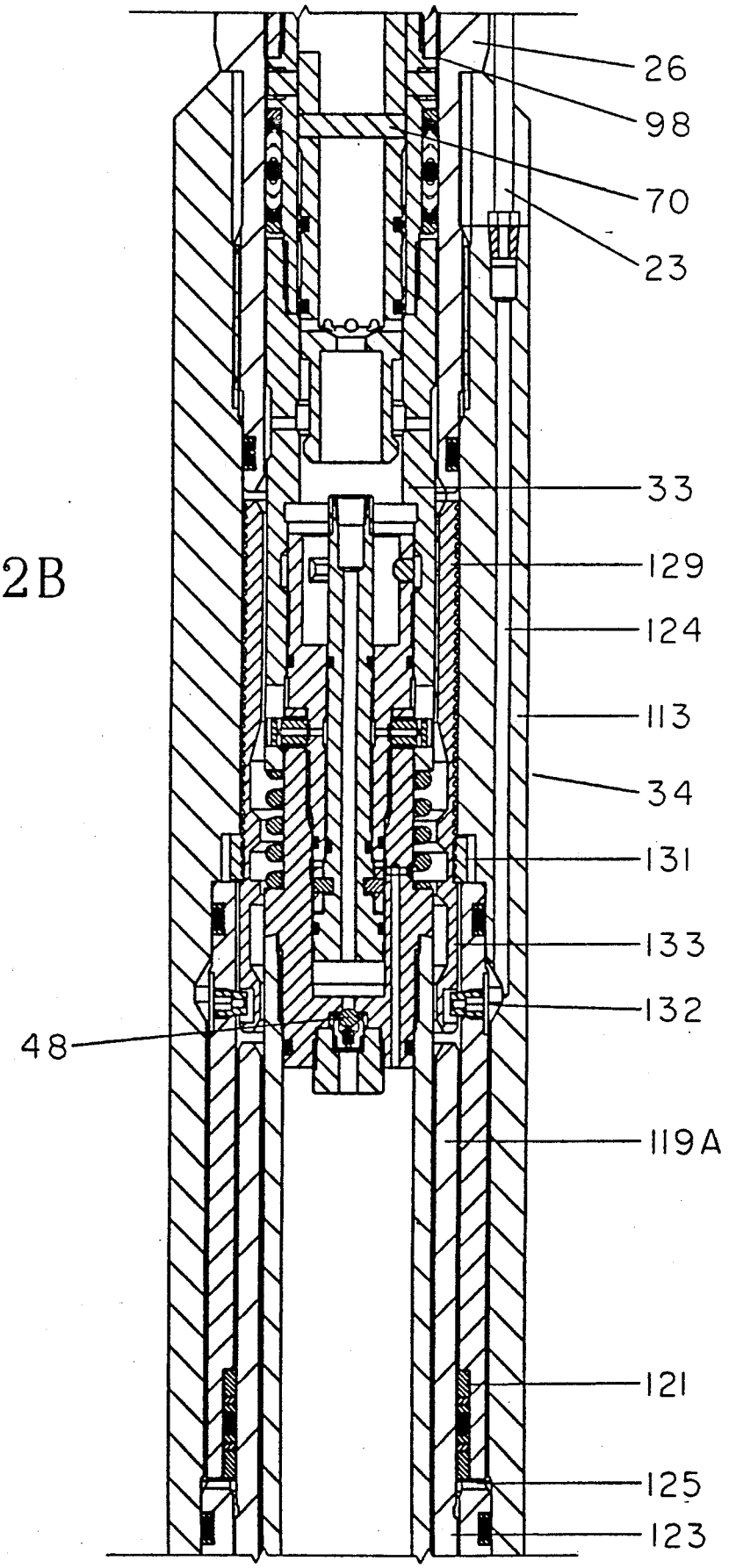

The two landing nipples 24 and 26 have a smooth bore in their lower section to receive packing which is slightly smaller in diameter than the profile section of the nipple resulting in a shoulder 98 (FIG. 2B). As the tool passes through the upper nipple 24 this shoulder is engaged by enlarged heads **99*a* of a locating collet 99 slidably carried by the key retainer sleeve 92. The upper ends of the locating collet engage a retractor 101 which is urged downwardly by a locator spring 102 to yieldably hold the collet in its lower position. When the collet heads engage the smooth bore shoulder 98 in the upper landing nipple 24 the spring is compressed allowing the tool to move downwardly through the collet until the enlarged collet heads snap into a reduced diameter section 104 of the key retainer sleeve 92. The collet heads have an external frustroconical surface on their upper ends which then slip under a matching surface on the lower inner end of the retractor 101**.

Figure 6:
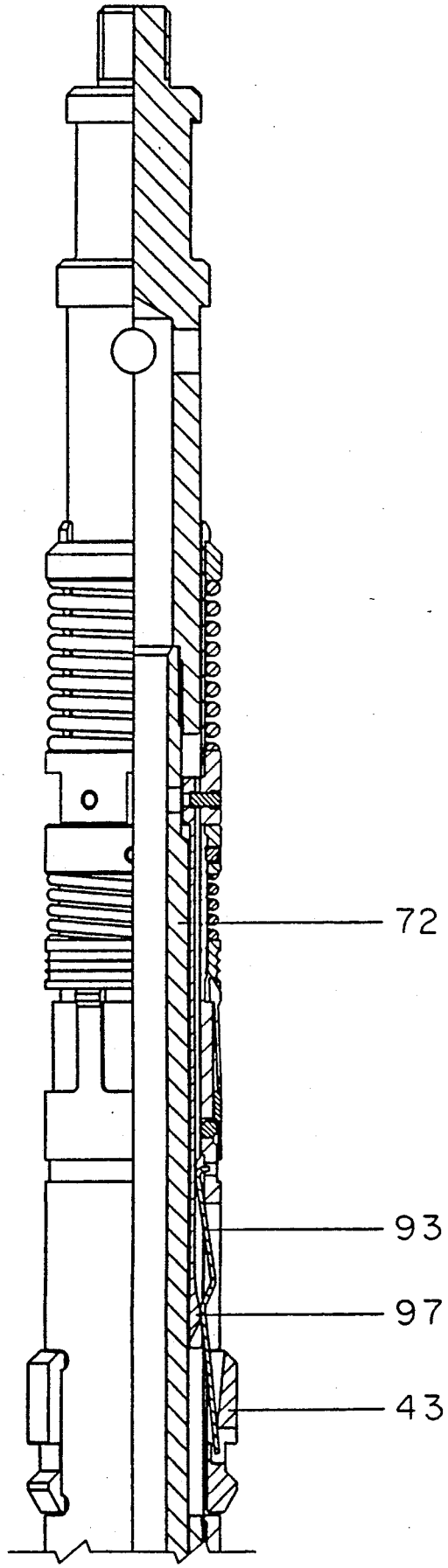
FIG. 6 is a view partly in section and partly in elevation of a bypass latch after passing through a first landing nipple and being cocked and ready for landing in a second landing nipple.

When the tool is moved downwardly relative to the collet a ball 105 carried by the key retainer sleeve 92 is released from a milled depression 106 in the exterior surface of the expander sleeve 96 (FIG. 2A). The ball 105 has been retaining the expander sleeve in the position shown in FIG. 5A. When the ball is released the expander sleeve 96 is moved downwardly by load spring 108 to position the propout section 97 of the expander sleeve below the curved section **93*a* of the spring to move the spring outwardly resulting in outward movement of the keys 43 (FIG. 6). The spring 108 is held between enlarged heads 109*a* on the upper end of vertical fingers 109 which extend upwardly from the key retainer sleeve 92 (FIG. 16). The spring retainer 111 is pinned to the expander sleeve by shear pin 112. The tool travels downward with the latch assembly in the FIG. 6 relationship until the keys land in the key profile 44 of the landing nipple 26** as shown in FIG. 2A.

When the latch is landed in nipple 26 downward jarring will shear the shear pin 70 as shown in FIG. 2B. As the actuator mandrel 72 is moved downward relative to the keys, the lower end of the fishing neck 76 engages the top of the the lower end of the fishing neck 76 engages the top of the expander sleeve 96 moving the expander sleeve downwardly with the actuator mandrel until the propout section 97 is behind the keys and locks the keys in the landing nipple profile. During this downward movement the spring retainer 111 for the load spring 108 will engage the cap 113. When this occurs the shear pin 112 will shear and release the expander sleeve. This permit the fishing neck and actuator to move downward in the key retainer sleeve 92. With the actuator released and the propout 97 locking the keys in the profile 44 the actuator mandrel 72 may be manipulated to release the pressure fluid, the subsurface valve 34 opened and pressure across the plug equalized.

After the pressure has been equalized across the plug the tension of the wire line is relaxed permitting the lugs 84 to release the actuator flange 87. Thereafter lifting of the fishing neck 76 by the wire line will raise the actuator 72 until the upwardly facing shoulder 72*a* on the actuator engages a downwardly facing shoulder 96*b* on the expander sleeve. Continued upward movement of the fishing neck and actuator sleeve will withdraw the expander sleeve propout section 97 from behind the keys and they release the profile permitting the tool to be withdrawn from the well.

The subsurface safety valve 34 has a body provided by an upper piston section 113, threaded at its lower end to a connector sub 114, which is threaded to an intermediate spring section 115, which is threaded to a lower valve section 116.

In the valve section 116 a valve seat 117 and its cooperable valve member 51 are positioned to control flow through the safety valve. The valve member is urged toward its seat by spring 118. Opening and closing of the valve member is controlled by the actuator 119. At its upper end the actuator has a reduced external diameter section 119*a*. A seal 121 in the body slidably seals with the section 119*a*. A seal 122 on the upper end of the large diameter section of the actuator slidably seals with the connector sub 114. This construction results in a piston 123 on the actuator. The chamber between the two seals is exposed to fluid in passageway 124 by port 125. The passageway is connected to the control conduit 23 for surface control of pressure on the piston. A spring 126 in a spring chamber 127 provided between the spring housing section 115 and the actuator 119, is supported on an upwardly facing shoulder 128 and urges the actuator upwardly.

The valve is provided with a lockout sleeve 129 which when moved downwardly cooperates with a C-ring 131 to lock the actuator in its open position. The sleeve 129 is held in its upper position by the shear plugs 132. When the profile 133 in the sleeve is engaged by a shifting tool the plugs may be sheared and the sleeve moved downwardly to a position locking the actuator in open position. Thereafter a wire line valve may be position with seals straddling the plugs 132 in the conventional manner.

To insure free flow of fluid into the spring chamber and against the lower pressure responsive surface of the piston 123 ports 133 are provided in the lower end of the actuator 119. This permits entrapment of air or gas in the spring chamber. When installed in oil wells the spring chamber can be expected to substantially fill with liquid when installed and any air or gas in the chamber will be compressed into a small area. Breathing of the chamber as pressures change will also tend to remove gas or air. In a gas well this spring chamber will remain filled with gas or air which must be compressed by pressure from the plug 33. This is undesirable as it increases the volume of compressed fluid to be carried by the plug.

Figure 2C:
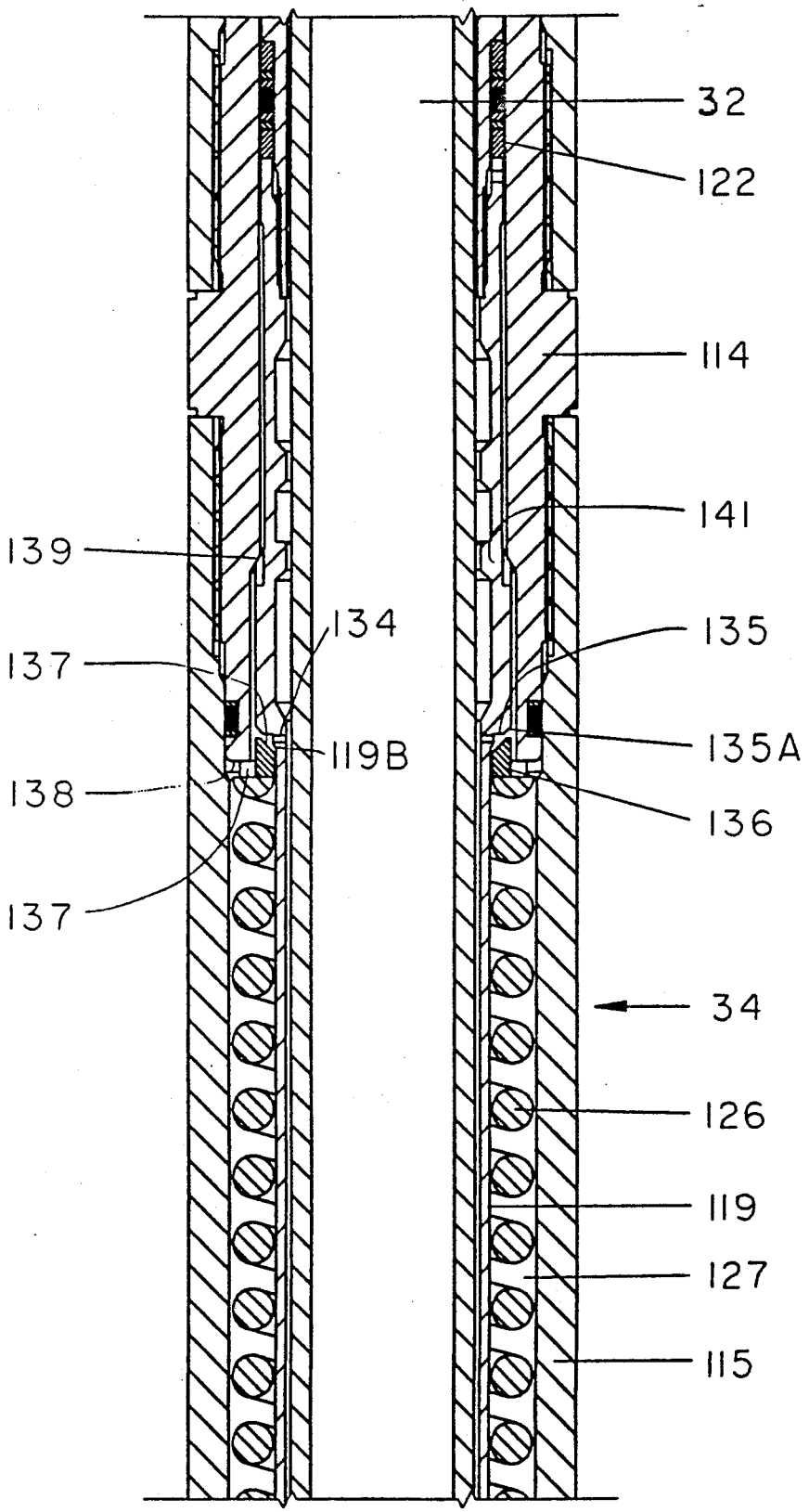
Figure 2D:
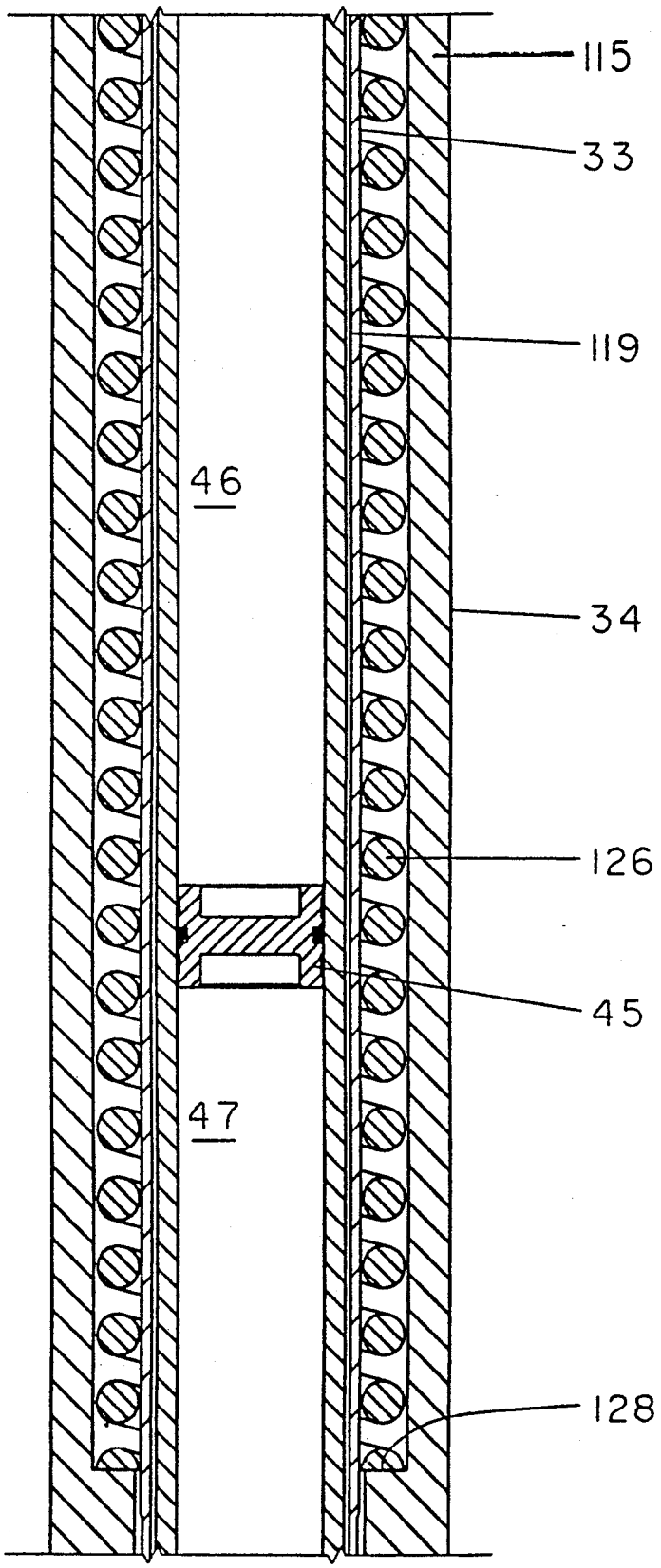
Figure 2E:
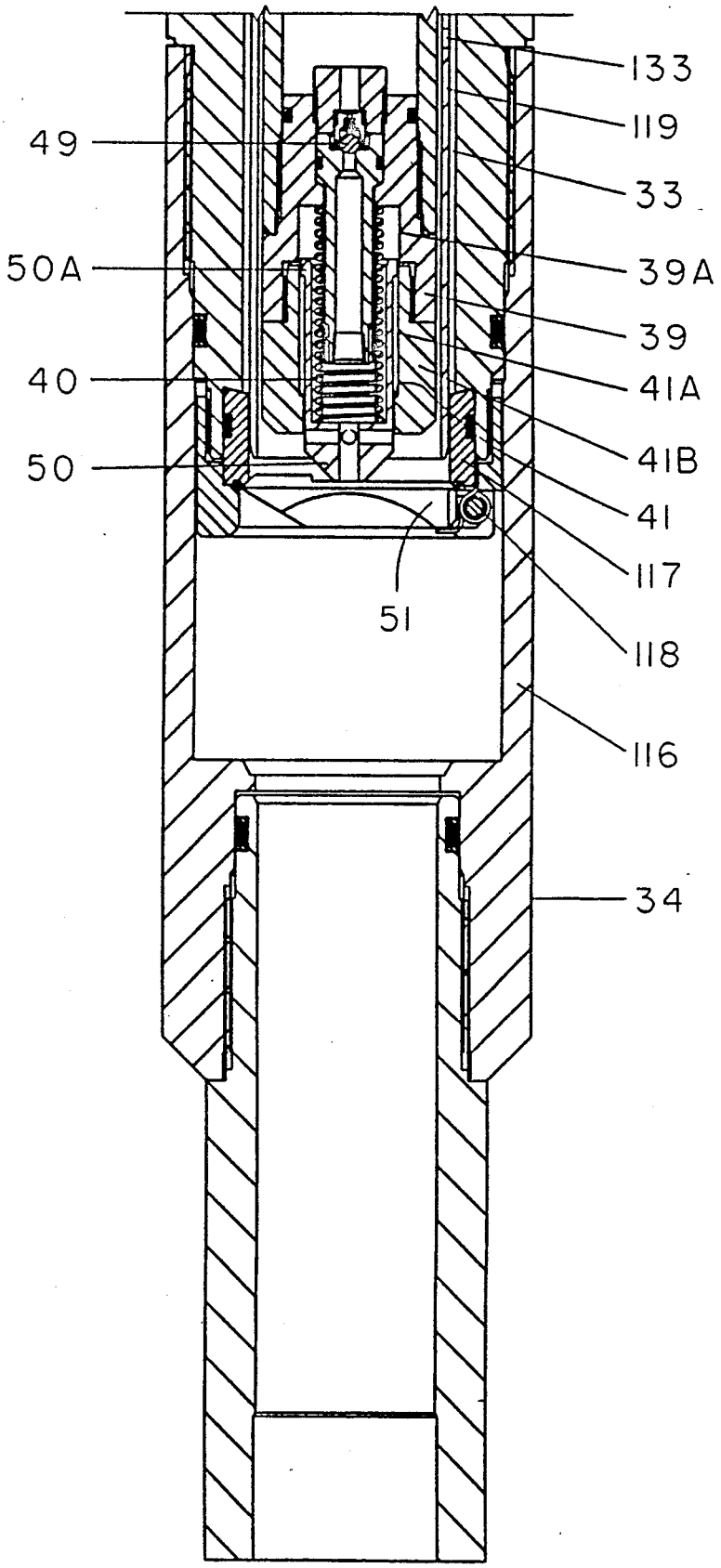
Figure 3A:
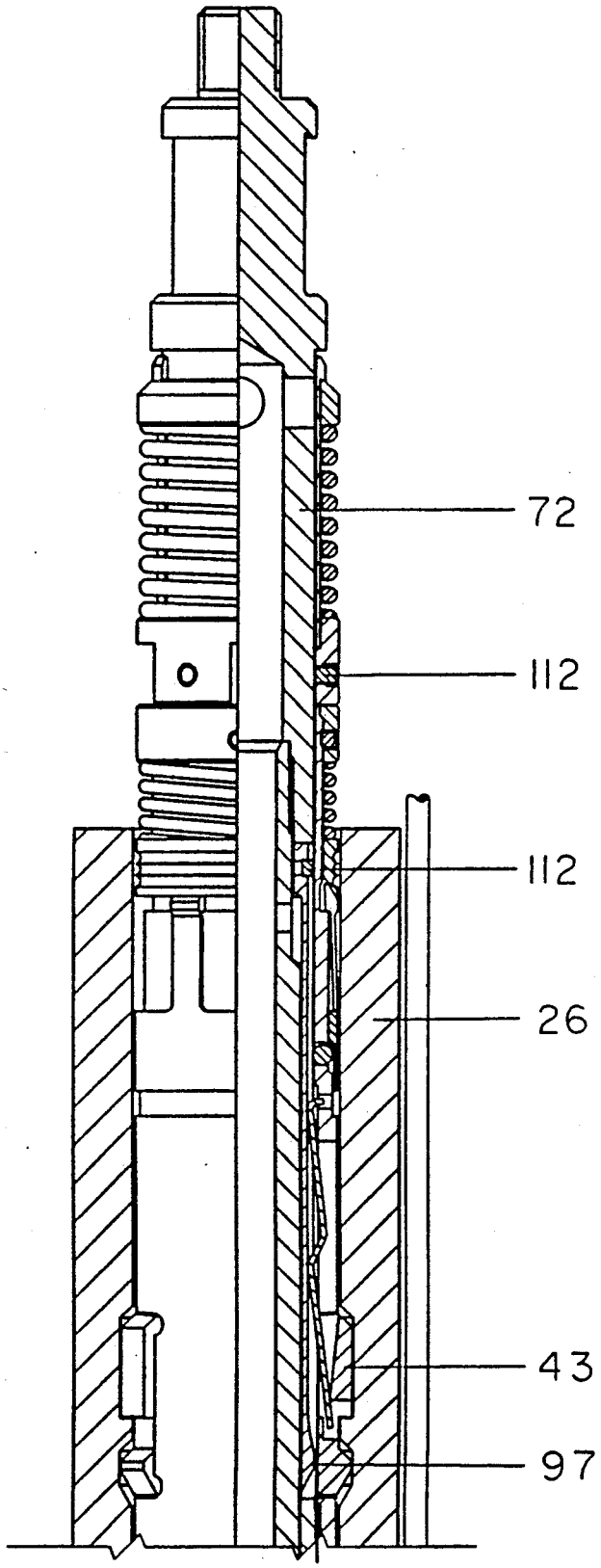
FIGS. 3A and 3B are similar continuation views partly in section and partly in elevation of the tools shown in FIGS. 2A and 2B showing the keys locked in landed position and pressure fluid being transferred from the plug to 5 equalize pressure across the valve member of the safety value.
Figure 3B:
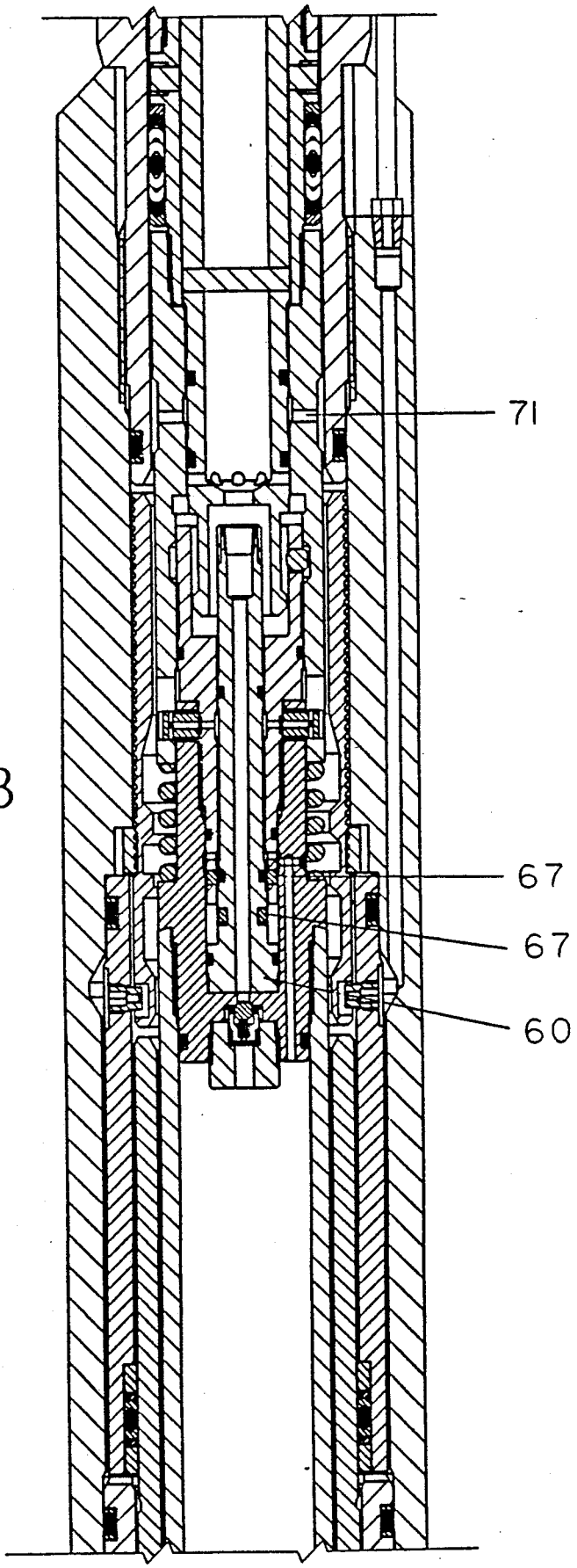

The safety valve 34 is provided with ports 134 in the upper end of the actuator tube 119 (FIG. 2C). These ports are immediately below the downwardly facing shoulder 135 on the actuator where the spring applies its upward force to the actuator. These ports permit fluid to flow therethrough into the upper end of the spring chamber. Thus when liquid is dumped into the safety valve before running the plug this liquid will rise in and can be expected to substantially full the spring chamber eliminating the need for extra capacity for fluid under pressure being carried by the plug. If these upper ports 134 remain open while the well is producing problems may occur from solids such as sand being deposited in the spring chamber. Also flow of well fluids through the chamber may result in corrosion. This is particularly undesirable in the case of the spring as the spring rate may be effected.

In accordance with this invention the upper ports 134 are open when the safety valve is closed to permit the spring chamber to be filled with liquid, and closed when the safety valve is open to prevent flow through the ports and spring chamber. The ports are controlled by placing between the downwardly facing shoulder 135 on the actuator and the upper end of the spring 126 a seal ring 136. The upper surface of the ring is beveled at 137 to provide a frustroconical seal surface. The shoulder 135 has a conforming surface 135*a* to seal with the ring above the ports 134. The actuator has an external seal surface 119*b*below the ports 134 also for engagement by the ring seal surface 137. Thus when the spring 126 is exerting an upward force on the actuator the ring seal surface is in engagement with the two seal surfaces 119*b* and 135*a* to seal therewith. As the seal surfaces are metallic a perfect seal may not occur but the seal will be sufficient to prevent the movement of solids through the ports and inhibit the flow of gas through the ports.

The seal ring 136 has an outwardly extending vertically slotted flange 137 which engages the lower end of the connector sub 114 when the spring 126 is fully extended. The upward travel of the actuator is limited by engagement of shoulders 139 and 141 on the actuator and connector sub 114. These shoulders are positioned such that the actuator when in the full up position disengages the ring from the seal surfaces on the actuator and opens ports 134. The pressure within the safety valve when closed will normally be several hundred pounds. When the force exerted by control fluid pressure is less than the force exerted by pressure in the spring chamber the actuator will travel to its full up position shown in FIG. 2C where the ports 134 are open to permit filling the spring chamber with liquid. If desired, force exerted on the bottom of the piston may be increased to obtain the desired differential across the piston to insure that the actuator is in its full up position during filling of the chamber with liquid. When the control line is pressurized to maintain the safety valve in open position the seal ring will be held between the seal surfaces on the actuator and the compressed spring to close the ports 134 as shown in FIG. 4B.

In operation a subsurface safety valve 25 is made up in a tubing immediately below a landing nipple 26 as shown in FIG. 1. An upper landing nipple is also included in the tubing. While the plug of this invention may be used to open other safety valves it is preferred that the valve 34 as shown in FIGS. 2A through 2E be used, particularly when the well is a gas well.

If desired, liquid may be dumped into the safety valve to fill the spring chamber 127. Pressure in the control line 23 is reduced so that pressure in the tubing will force the valve actuator 119 upward to the position shown in FIG. 2C to disengage the seal surfaces **119*b* and 135*a* from the ring 136. This exposes ports 137 and the chamber may be filled with liquid. With the safety valve closed as shown in FIG. 2E the plug 33 and bypass latch 32 are run in the well on a wire line with the tool as shown in FIGS. 5A and 5B. The lower end of the plug is as shown in FIG. 4C with the prong 50 extended. As the tool passes through the upper landing nipple the collet fingers will be arrested in their downward movement by shoulder 98 at the top of the seal bore of the nipple and the collet will move to the position shown in FIGS. 2A and 6**. The latch is now cocked and ready to land in a landing nipple.

Figure 7A:
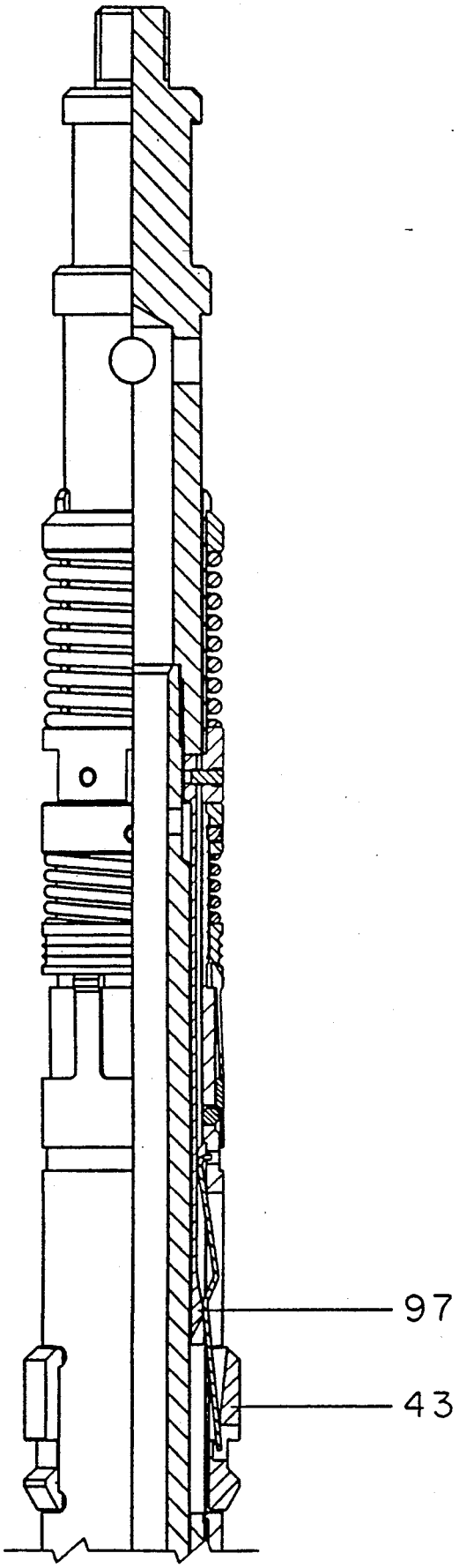
FIGS. 7A and 7B are continuation views partly in section and partly in elevation of the latch and plug, with the lower end of the plug omitted, similar to FIGS. 2A through 2E.
Figure 7B:
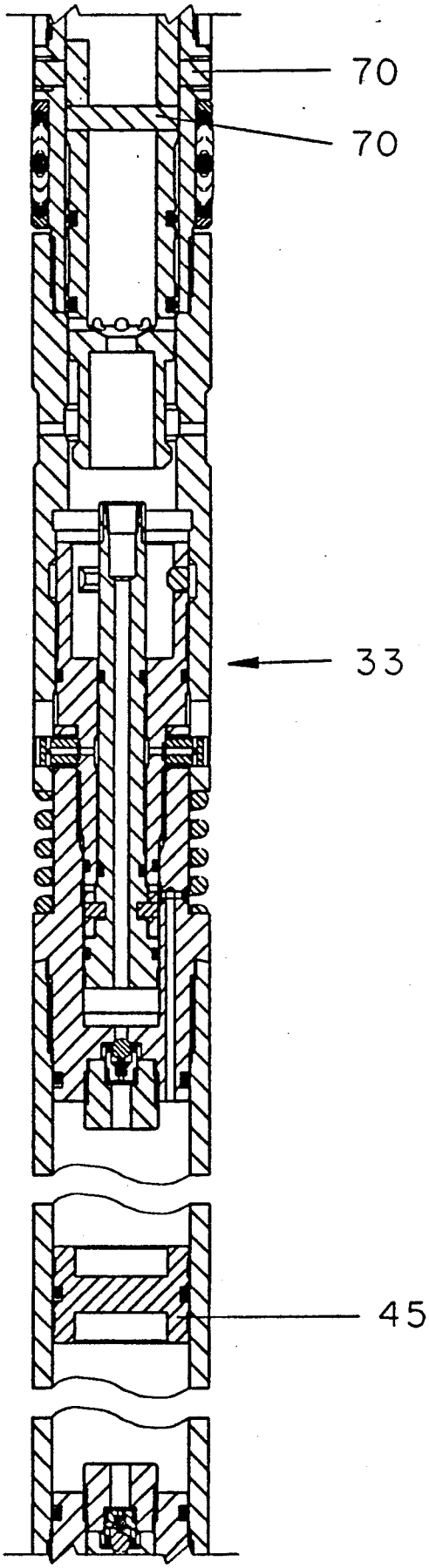
Figure 8A:
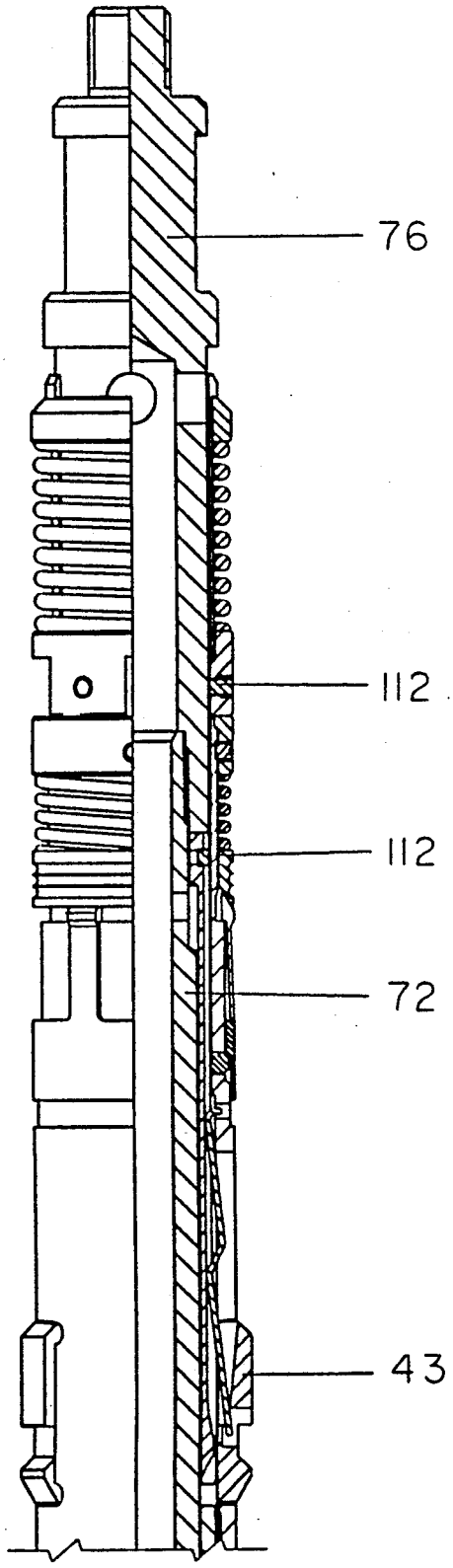
FIGS. 8A and 8B are continuation views partly in elevation and partly in section with the bottom of the plug omitted showing the plug and latch in position to shear a pin and release fluid from the plug.
Figure 8B:
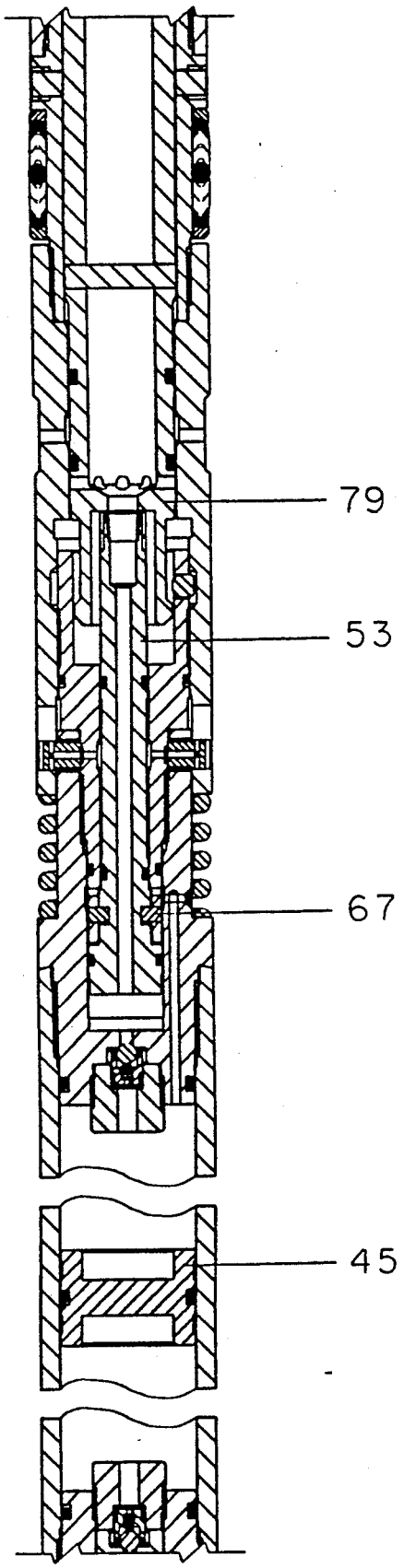
Figure 9A:
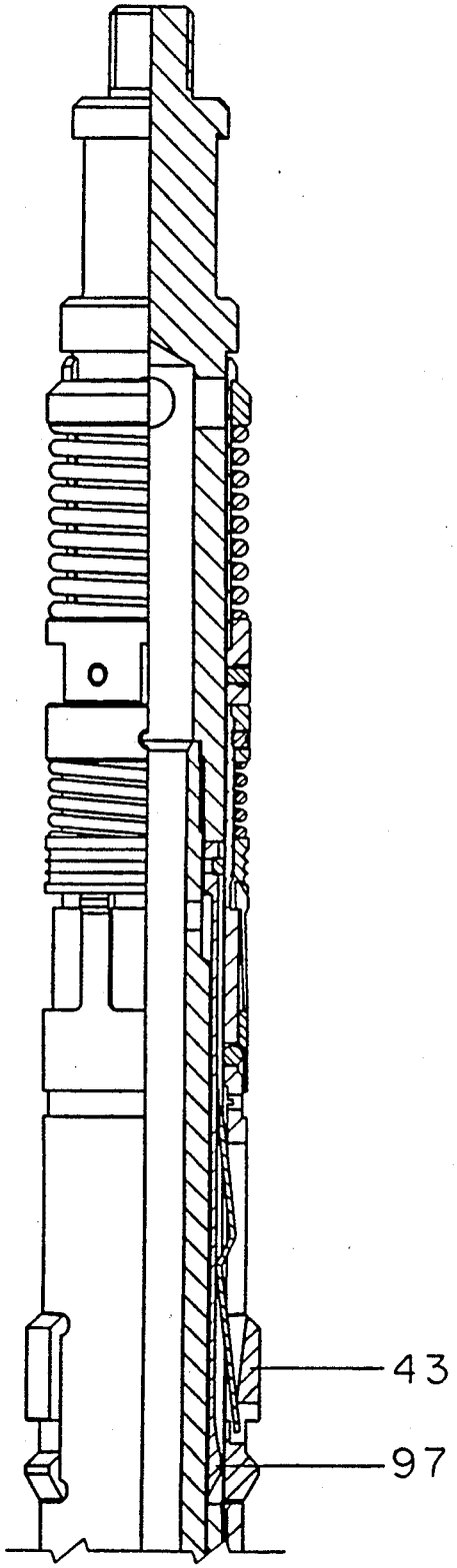
FIGS. 9A and 9B are continuation views similar to FIGS. 8A and 8B with pressure fluid being released from the plug.
Figure 9B:
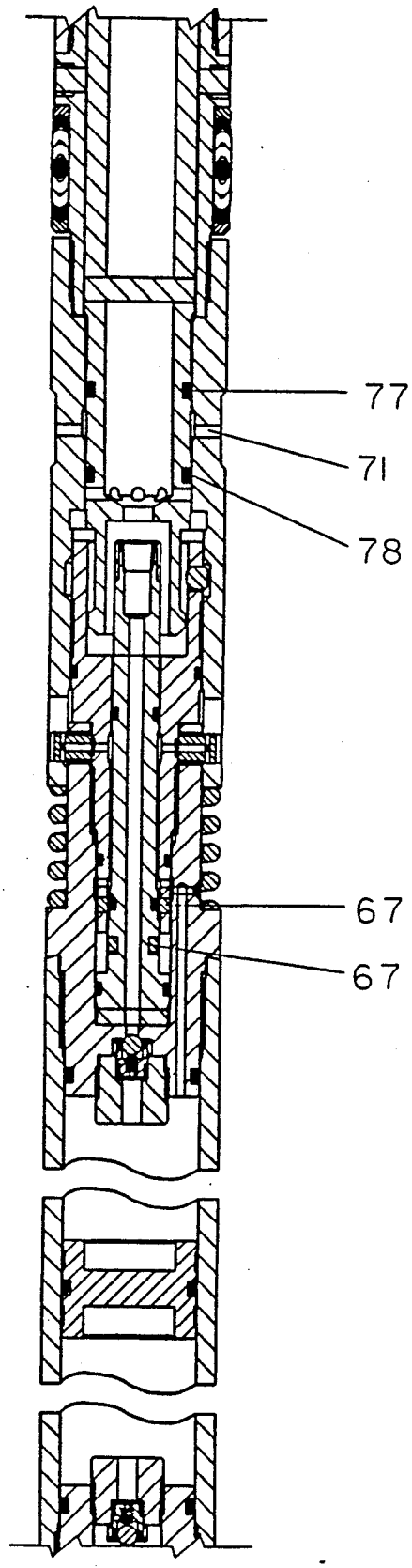

When the tool reaches the second landing nipple the keys 43 land in the profile in the nipple as shown in FIG. 2A. Further downward movement shears pin 70 as shown in FIGS. 2B and 7B releasing the actuator 72 from the housing. Thereafter pin 112 is sheared releasing the expander sleeve 96 and thus the actuator from the housing. The actuator and expander sleeve may now move downward relative to the housing as shown in FIGS. 8A and 8B until the actuator engages the top of the spool valve member 53 as shown in FIGS. 8A and 8B. At this time the propout section 97 at the lower end of the expander sleeve locks the keys in the profile in the landing nipple to lock the tool in position in the safety valve.

Figure 10A:
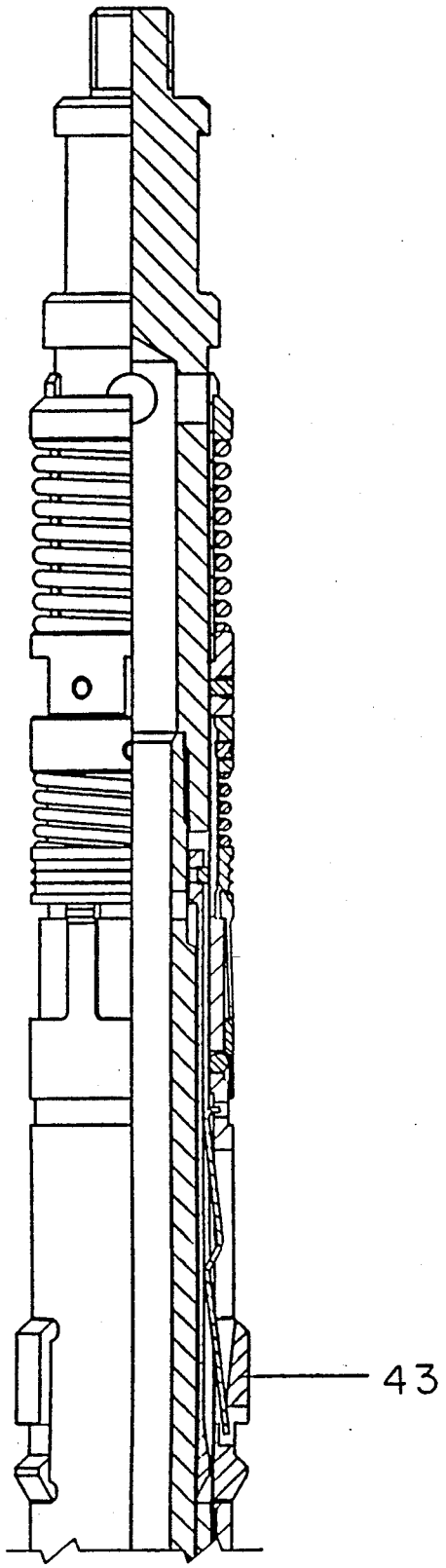
FIGS. 10A and 10B are continuation views similar to FIGS. 8A and 8B with pressure fluid released from the plug and the actuator latched to the plug housing prior to equalizing across the plug.
Figure 10B:
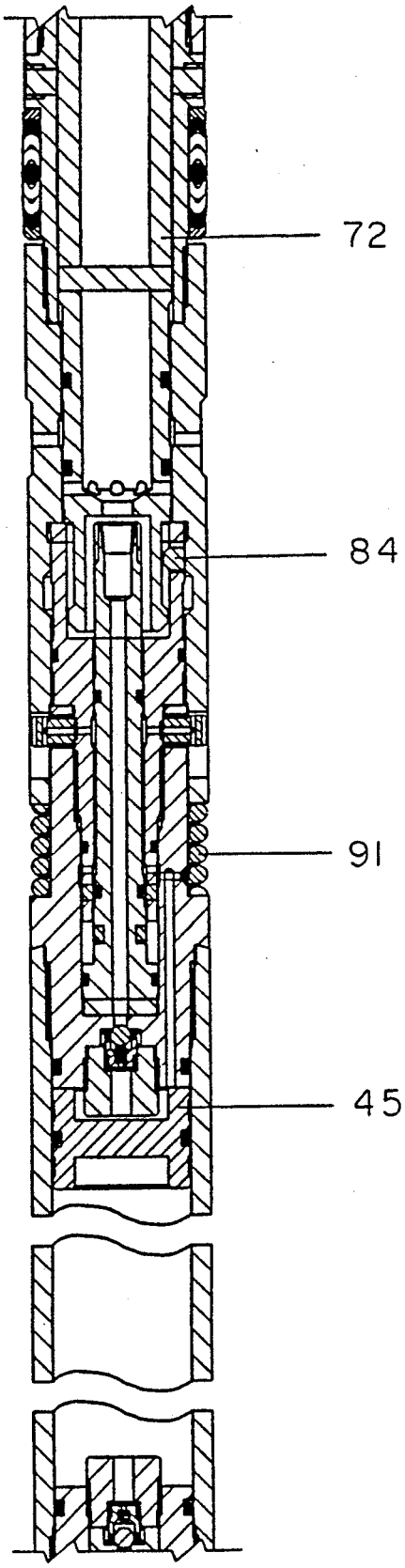

The actuator is now jarred down to move the spool valve member down and shear pin 67. As shown in FIGS. 9A, 9B, 3A and 3B the ports 71 are now closed by the actuator and the differential across piston 60 on the spool valve holds the spool valve in full open position and the liquid contents of chamber 46 is driven from the plug by the pressurized gas in chamber 47 until the pressure across the flapper valve member 51 is equalized as shown in FIGS. 10A and 10B. As pressure below the plug increases this pressure is effective on the piston provided by valve housing 37 and the housing and trap 52 are moved upwardly compressing spring 91 as shown in FIGS. 10A and 10B. This results in lugs 84 engaging the actuator to secure the actuator to the housing until pressure is substantially equalized across the plug.

The prong spring 40 is designed to exert a greater force than the flapper closing spring 118 and the prong unseats the flapper. Preferably the pressure in the chamber 47 is large enough that with the piston 45 in its upper position the pressure exerted on the upper surface of the flapper valve would be greater than pressure below the flapper if it did not open. This insures that sufficient pressure is available to open the flapper. After the flapper is opened this pressure is lost and pressure above the flapper is well pressure. The operator will note this condition from his control pressure gauge at the surface and know that the flapper is unseated. The operator now will pressurize the control line to move the flapper to its full unseated position as shown in FIGS. 4A, 4B and 4C. From FIG. 4B it will be noted that with the flapper in open position the ring 136 now covers the ports 135 and the spring chamber is protected against fluid and solids finding their way into the spring chamber.

Figure 11A:
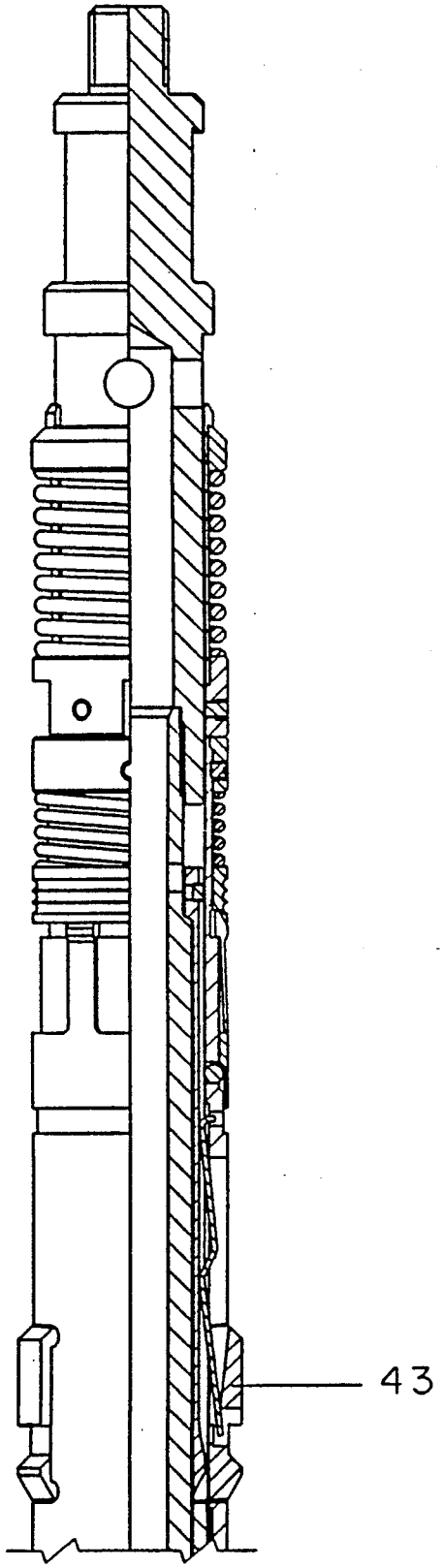
FIGS. 11A and 11B are continuation views similar to FIGS. 8A and 8B with pressure being equalized across the plug.
Figure 11B:
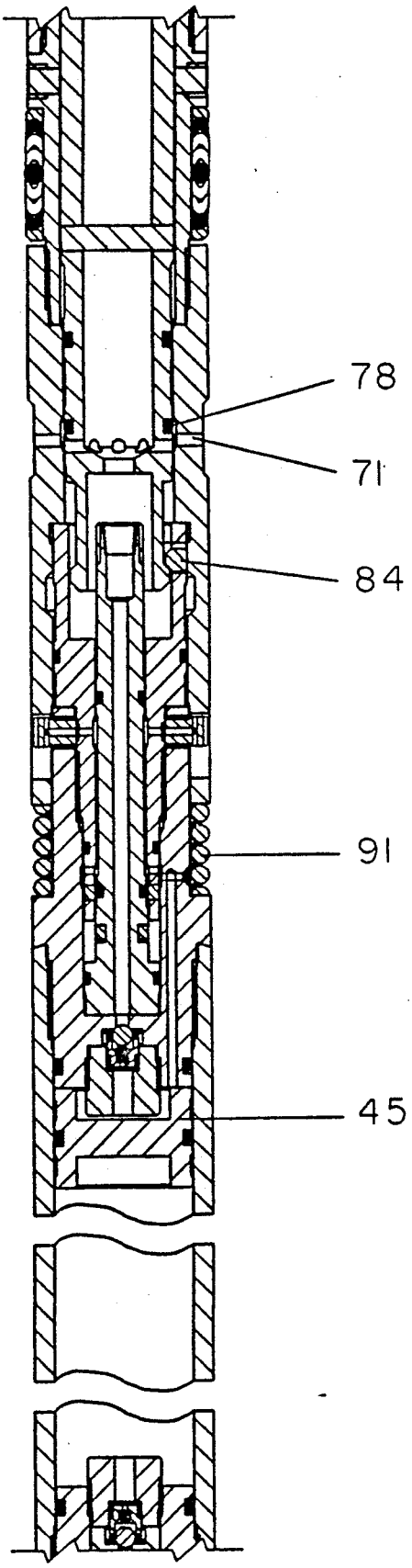
Figure 12A:
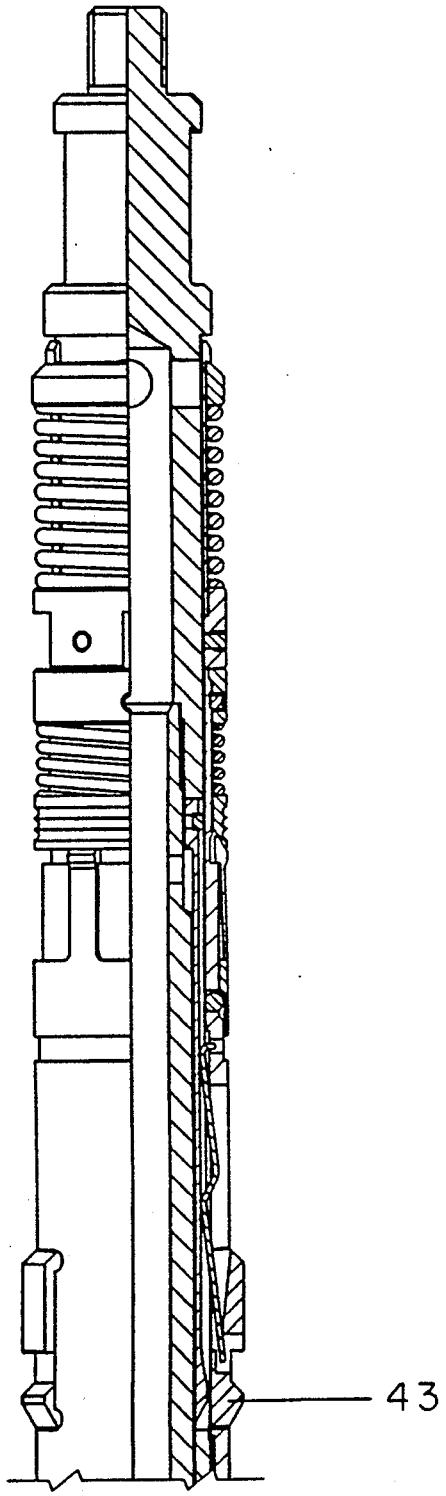
FIGS. 12A and 12B are continuation views similar to FIGS. 8A and 8B after pressure has been equalized across the plug and the parts are in position to release the actuator from the housing.
Figure 12B:
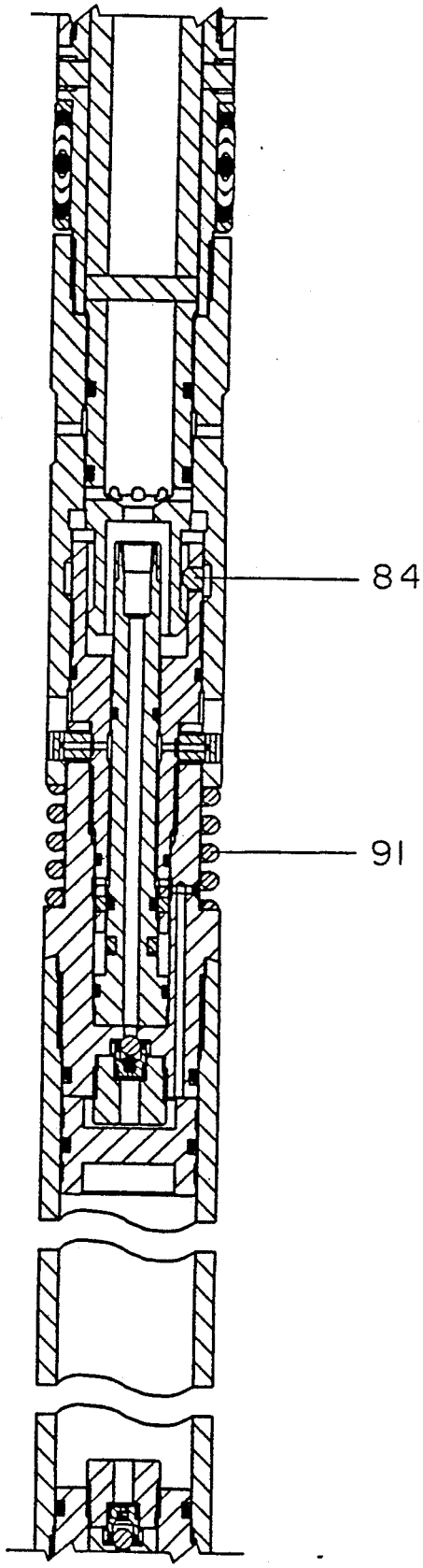

After the safety valve has been opened the plug is retaining the well pressure. To equalize pressure across the plug the operator now places the wire line in tension to lift the actuator to open the bypass ports 71 as shown in FIGS. 11A and 11B. As the lugs 84 are now in engagement with the actuator it is held against upward movement under the influence of well pressure to a position above that shown in FIG. 11B. As the equalizing ports are open pressure across the plug is now equalized. After the operator notes that well pressure is present at the well head the tension in the wire line is released. The return spring 91 now moves the trap downwardly as shown in FIGS. 12A and 12B and the lug may release the actuator.

Figure 13A:
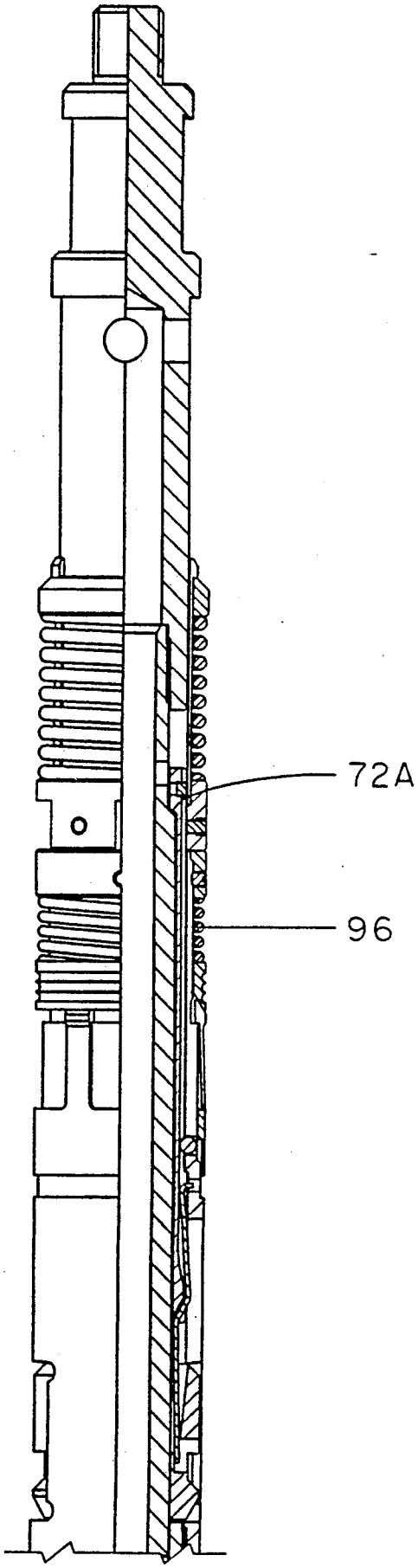
FIGS. 13A and 13B are continuation views similar to FIGS. 8A and 8B with the parts in position to be removed from the safety valve.
Figure 13B:
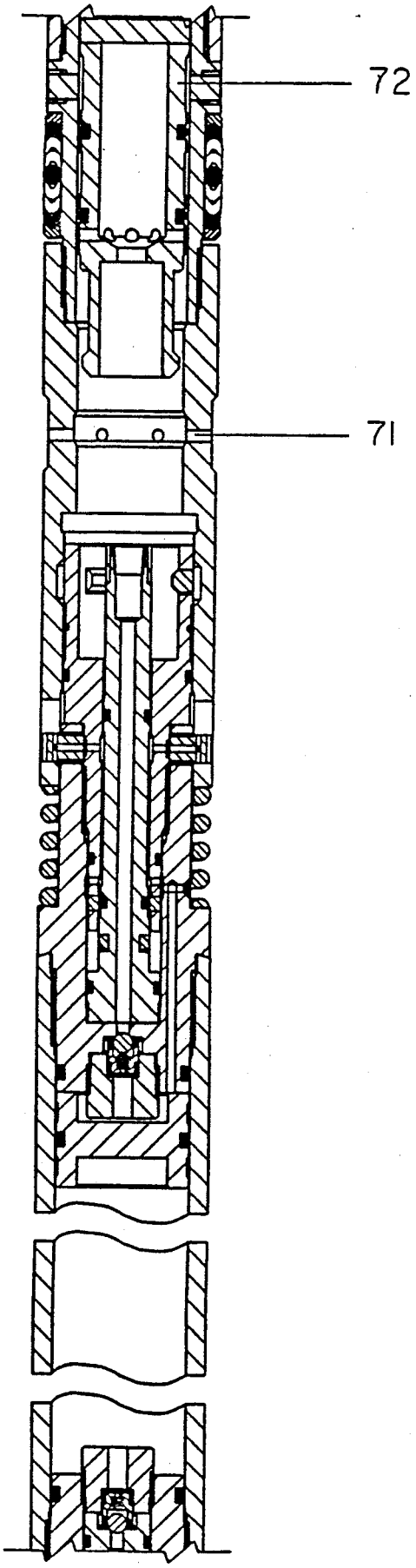

The tool is now pulled from the safety valve. As the actuator moves upwardly the shoulder **72*a* on the actuator engages the complementary shoulder on the expander sleeve and lifts the sleeve to the position shown in FIGS. 13A and 13B** to withdraw it from its propout position and release the tool from the landing nipple.

Figure 14A:
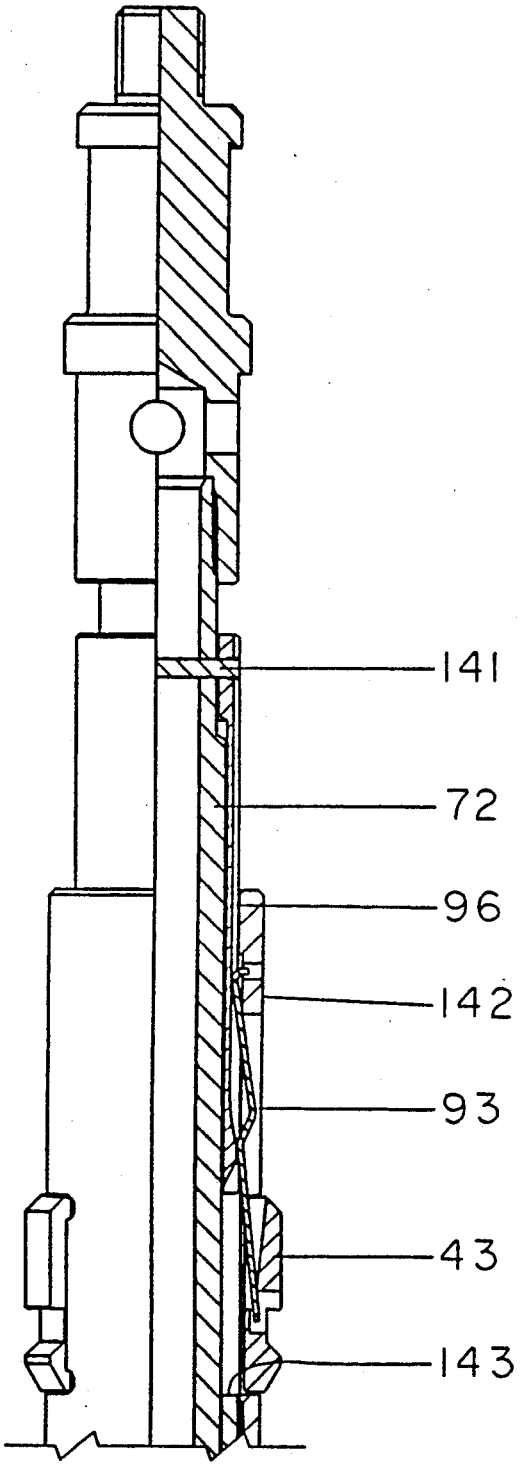
FIGS. 14A and 14B are continuation views partly in section and partly in elevation of a modified form of latch and plug with the bottom section of the plug omitted.
Figure 14B:
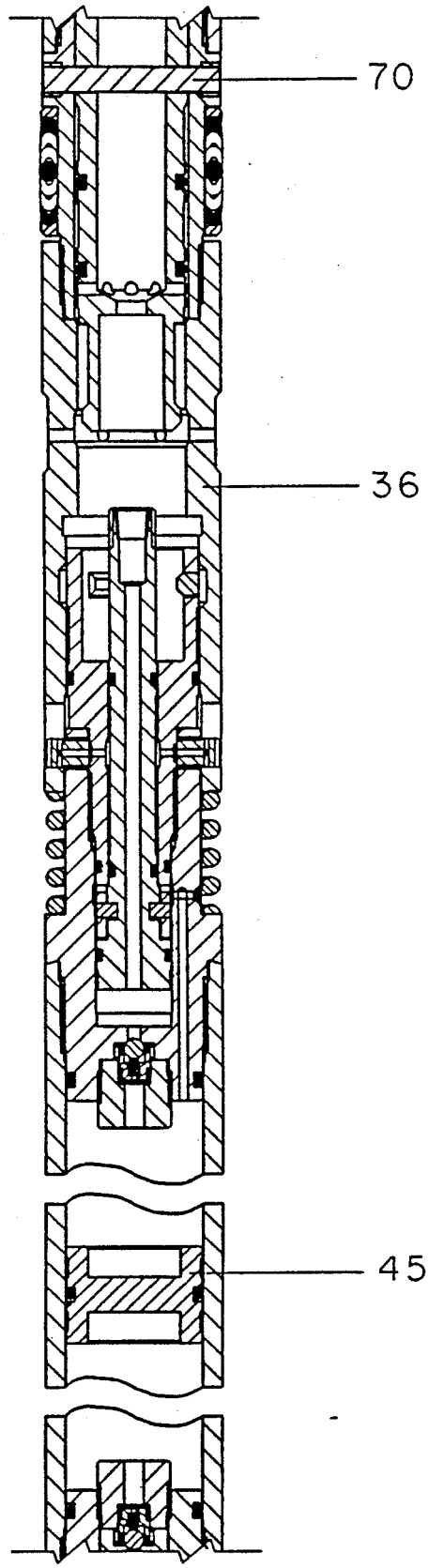

FIGS. 14A and 14B show the plug in combination with a standard latch. This latch will be used when there is not present a top landing nipple and only the landing nipple immediately above the safety valve is in the tubing. In the standard latch the expander sleeve 96 is carried on the actuator 72 by a shear pin 141 with the spring 93 held in radially expanded position to hold the keys 43 in position to land in the profile in the landing nipple. When the keys land the actuator and sleeve move downwardly until the expander sleeve bottoms in the key retainer sleeve 142 on shoulder 143. Pin 141 is then sheared and operation of the plug is as explained above as the elements of the plug are the same as in the preferred form of plug.

Figure 15C:
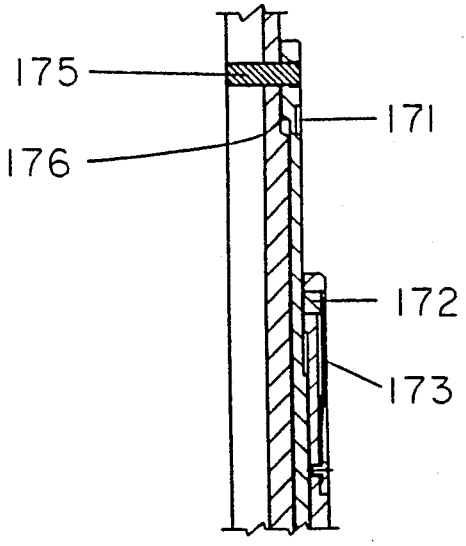
FIG. 15C is a sectional view taken along the lines A—A of FIG. 15A.
Figure 15A:
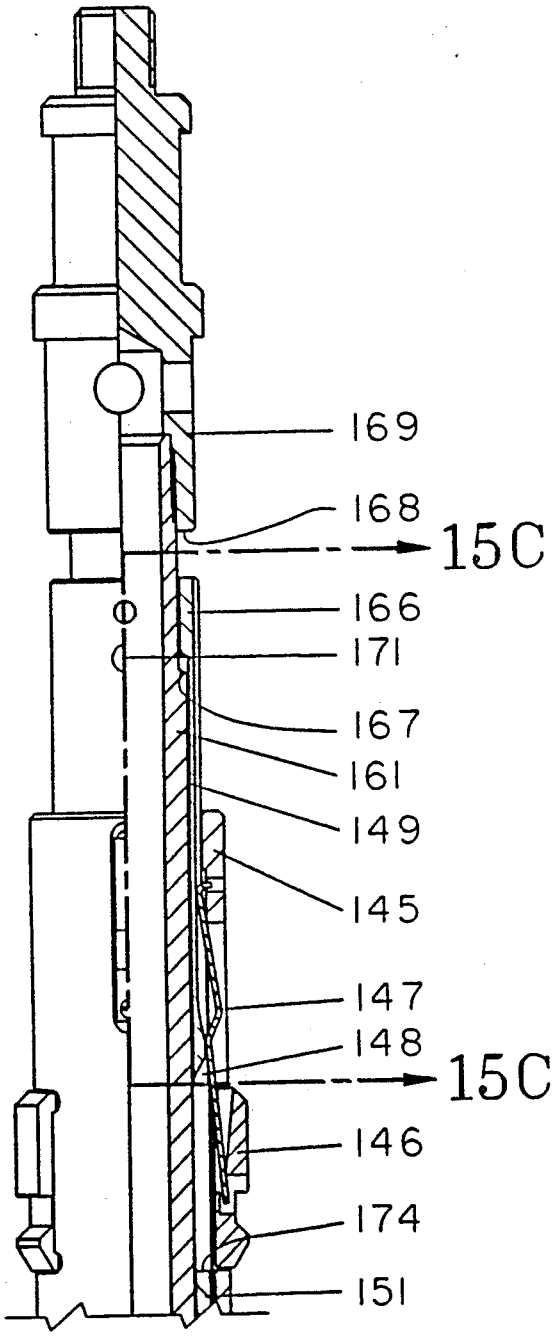
FIGS. 15A and 15B are continuation views partly in section and partly in elevation of a further modified form of latch and plug with the bottom section of the plug omitted.
Figure 15B:
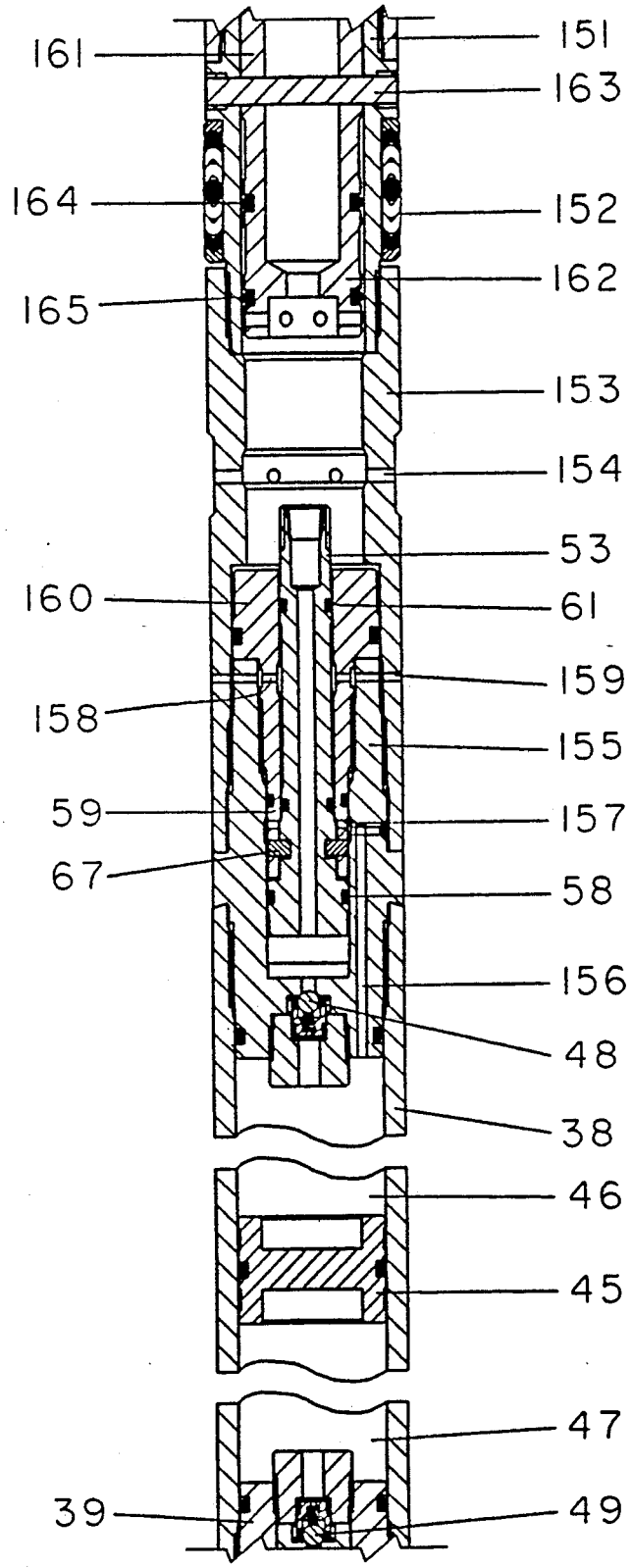

A further modified form of the invention is shown in FIGS. 15A, 15B and 15C. The housing includes a key retainer sleeve 145 which carries keys 146. The keys are urged outwardly by spring 147 which is held in key expanding position by the propout 148 on expander sleeve 149. Depending from the retainer sleeve is a packer mandrel 151 which carries packing 152. Below the sleeve is the bypass housing 153 having ports 154 therein. Secured to the lower end of the bypass housing is the valve housing 155 which supports the cylinder 38. Below the valve housing 155 the tool is identical with the tool of FIG. 2A through 2E.

The valve housing 155 has flowways 156 therein for cooperation with ports 157 and 158 in the spool valve seat 160 and ports 159 in the bypass housing 153 for direction flow from the chamber 46 as hereinabove explained.

The actuator 161 has a flange 162 at its lower end for engagement with the upper end of the spool valve 61 as in the other designs. The actuator is pinned to the packing housing 151 by pin 163 and has O-rings 164 and 165 thereon for control of the bypass ports 154 as in the other design.

When the downwardly moving tool reaches the landing nipple the keys 146 will land in the profile in the nipple arresting movement of the body. Further downward movement will shear pin 163 releasing the actuator for downward movement. The expander sleeve 149 has an inturned flange portion 166 on its upper end slidable on the actuator between the upturned shoulder 167 on the actuator and the downwardly facing end 168 of the fishing neck 169 to which the wireline (not shown) is attached.

The expander sleeve is provided with holes 171 for engagement by shear pins 172 which are urged into the holes by springs 173 when in register. As the expander sleeve bottoms out on the upwardly facing shoulder 174 of the packer mandrel these shear pins 172 are forced into the holes 171 to latch the expander sleeve in its propout position. Shear pin 175 between the actuator and expander sleeve is now sheared releasing the actuator for further downward movement to shear the spool valve shear pins 67 and move the spool valve to open position where the pressure differential across the piston on the lower end of the spool valve holds it in full open position. The lower O-ring 165 on the actuator passed the bypass holes 154 in the bypass housing to prevent flow therethrough as the spool valve was moved to its lower position by the actuator. As in the other designs fluid from chamber 46 is now ejected into the safety valve. After the safety valve is equalized and opened as explained hereinabove the wire line is placed in tension and the actuator raised until its upwardly facing shoulder 167 engages the lower shoulder 176 on the flange portion 166 of the expander mandrel. This upward movement of the actuator moves the O-ring 162 above the bypass ports 154 establishing fluid flow across the plug to equalize pressure across the plug. During equalization the actuator is in engagement with the flange 166 on the expander flange which is pinned to the housing and the actuator is held against upward movement.

After pressure has been equalized the fishing neck is jarred upwardly to shear pins 172 releasing the expander sleeve from the housing and the propout portion of the sleeve is withdrawn from behind the keys releasing the keys from the landing nipple and the tool may be withdrawn from the hole.

The foregoing description and drawings of the invention are explanatory and illustrative only, and various changes in sizes, shapes, and arrangement of parts, as well as certain details of the illustrated construction may be made within the scope of the appended claims without departing from the true spirit of the invention.

What is claimed is:

1. A bypass latch for running a tool past a first landing nipple and landing the tool in a second landing nipple comprising;

a key retainer, a plurality of keys in said retainer, a key expander sleeve reciprocal within the key retainer, a spring engaged by said expander sleeve and in a first position of said expander sleeve retracting said keys and in a second position of said expander sleeve urging the keys radially outward, collet means slidable on said key retainer and in one position holding said expander sleeve in its first position, said collet means movable along said key retainer to a second position by engagement with a landing nipple and retracted to a nonengaging position and releasing said expander sleeve, means retaining said collet in said nonengaging position, and means moving said expander sleeve to its second position in response to said collet moving to its second position.

2. The latch of claim 1 wherein means urges said collet toward its first position.

3. The latch of claim 1 wherein an actuator means moves said expander sleeve between said first and second position and a third position where the keys are held in their radially expanded position, and means for releasing the actuator means from the expander sleeve with the keys in their expanded position; in combination with:

a first valve which is alternatively opened and closed by said release actuator, and a second valve which is opened by said released actuator.

* * * * *